US005363008A

United States Patent [19]

Hiramoto et al.

[11] Patent Number: 5,363,008

[45] Date of Patent: Nov. 8, 1994

[54] CIRCULAR ACCELERATOR AND METHOD AND APPARATUS FOR EXTRACTING CHARGED-PARTICLE BEAM IN CIRCULAR ACCELERATOR

[75] Inventors: Kazuo Hiramoto, Hitachiota; Junichi Hirota, Hitachi; Masatsugu Nishi, Katsuta; Hiroyuki Watanabe, Hitachi; Kenji Miyata, Katsuta, all of Japan

[73] Assignee: Hitachi, Ltd., Tokyo, Japan

[21] Appl. No.: 958,161

[22] Filed: Oct. 8, 1992

[30] Foreign Application Priority Data

Oct. 8, 1991 [JP] Japan ..... 3-260094
Mar. 10, 1992 [JP] Japan ..... 4-051273

[51] Int. Cl.[5] ..... H05H 13/00

[52] U.S. Cl. ..... 313/62; 315/500; 315/504; 315/507

[58] Field of Search ..... 313/62; 250/492.3; 315/541; 328/233, 234, 237, 229, 235; 324/250, 71.3, 71.4

[56] References Cited

U.S. PATENT DOCUMENTS

| | | | |
|---|---|---|---|
| 3,328,708 | 6/1967 | Smith et al. | 313/62 |
| 4,607,194 | 8/1986 | Yin | 324/71.4 |
| 4,806,871 | 2/1989 | Ikegami et al. | 328/235 |
| 4,870,287 | 9/1989 | Cole et al. | 328/235 |
| 5,001,437 | 3/1991 | Miyata et al. | 328/235 |

OTHER PUBLICATIONS

Accelerators, Machines of Nuclear Physics (1960).
AIP Conference Procedings No. 127 (1983), pp. 53–61.
"Design of Synchrotron For Injection", USSOR-7 (Mar. 1981), pp. 26–27'and 81–87.

*Primary Examiner*—Donald J. Yusko
*Assistant Examiner*—Vip Patel
*Attorney, Agent, or Firm*—Antonelli, Terry, Stout & Kraus

[57] ABSTRACT

A circular accelerator for extracting a charged-particle beam is arranged to increase displacement of the beam by the effect of the betatron oscillation resonance and increase the betatron oscillation amplitude of the particles, which have initially betatron oscillation within the stability limit for the resonance, to exceed the stability limit thereby extracting the particles exceeding the stability limit of the resonance.

63 Claims, 28 Drawing Sheets

CIRCULAR ACCELERATOR AND METHOD AND APPARATUS FOR EXTRACTING CHARGED-PARTICLE BEAM IN CIRCULAR ACCELERATOR

CROSS-REFERENCE TO RELATED APPLICATION

This application is relating to copending U.S. patent application Ser. No. 07/857,660 filed on Mar. 26, 1992.

BACKGROUND OF THE INVENTION

1. Field of the Invention

The present invention relates to a circular accelerator for circulating a charged-particle beam and extracting the beam and a method and an apparatus for extracting the charged-particle beam.

2. Description of Related Art

Conventionally, a circular accelerator is arranged to circulate a charged-particle beam containing accelerated electrons or ions and extract the beam out of the circulating orbit. A transport line is used to transport the extracted beam to a location where it is used for physical experiment or medical use. For the conventional method for extracting the charged-particle beam, the resonance of betatron oscillation caused in the beam has been utilized as discussed in AIP Conference Proceedings No. 127 (1983), pages 53 to 61.

The resonance of the betatron oscillation is a phenomenon as follows. The charged particles circulate while oscillating right and left or up and down. This is referred to as a betatron oscillation. The number of betatron oscillations per one circulation is referred to as a tune. The tune can be controlled by a bending electromagnet or a four-pole electromagnet. When a resonance-generating six-pole electro magnet provided in a circulating orbit is excited at a time when the tune comes closer to an integer $\pm\frac{1}{3}$, an abrupt increase of a betatron oscillation amplitude takes place for those charged particles, which have higher betatron oscillation amplitudes than a given threshold value, among the circulated charged particles. This phenomenon is referred to as a resonance of betatron oscillation. The threshold value is referred to as a stability limit. The magnitude of the betatron oscillation amplitude of the stability limit varies depending on a deviation of the tune from an integer $\pm\frac{1}{3}$. It becomes smaller as the tune comes closer to an integer $\pm\frac{1}{3}$. By utilizing this characteristic, in the conventional technique, the tune is gradually approached to an integer $\pm\frac{1}{3}$, that is, the stability limit is gradually made smaller from an initial large value, so that the resonance first takes place in the charged particles having larger betatron oscillation amplitudes among the circulated charged particles and then the occurrence of the resonance is gradually prevailed to the charged particles having smaller betatron oscillation amplitudes, thereby beam extracting gradually the charged-particle beams.

As another method for extracting a charged-particle beam, a kicker electromagnet has been used as discussed in "Design of Synchrotron for Injection" UVSOR-7 (March, 1981), Particle Science Laboratory, pages 26 to 27 and 81 to 87.

The foregoing related arts have the following problems.

At first, it has a problem such that if the stability limit becomes smaller, the beam collides against a deflector wall provided at an extracting port, so that the charged particles may not be extracted. That is, even though the betatron oscillation amplitudes of the charged particles are substantially uniformly distributed, it is difficult to extract out the charged particles having betatron oscillation amplitudes lower than a certain value. This results in lowering an efficiency in extraction of the charged particles.

Second, it has another problem such that the orbit gradient of the charged particles extracted at the stability limit changes at the extracting port. Since the extracting deflector is located at a fixed angle with the circulating orbit, the charged particles, which are extracted at an angle deviated from the fixed angle by more than a certain angle, may collide with an inner wall of the transportation system including the extracting deflector to disappear. It lowers an efficiency in extraction of the charged particles. As another shortcoming, the extraction current changes and it is difficult to control it at a desired state. When the orbit gradient of the charged particles changes, the position at the outlet of the transportation system where the charged particles are extracted is also changed.

Third, it has a further problem such that the increment of the betatron oscillation amplitude per one circulation changes as the beam is being extracted, resulting in variation of the beam diameter.

Fourth, it has a still further problem such that the change of the extracting position at the outlet of the transportation system or the change of the extracting current or the beam diameter as the beam is being extracted is not preferable to any physical experiment or medical treatment.

Fifth, it has still another problem such that when the excitation of the four-pole electromagnet is changed for reducing the stability limit, the stability limit temporarily disappears and then again restores. No resonance takes place in a part of the beams, resulting in decrease of an extraction efficiency.

Sixth, it has a still further problem such that in order to obtain the sufficiently large strength of a magnetic field to extract the beam, many kicker electromagnets are needed. This prevents reducing of the accelerator size.

SUMMARY OF THE INVENTION

It is a first object of the present invention to provide a circular accelerator having a high efficiency in extraction of a charged-particle beam as circulated and a method and an apparatus for extracting the charged-particle beam.

It is a second object of the present invention to provide a circular accelerator which provides a large extracting current and a method and an apparatus for extracting the charged-particle beam.

It is a third object of the present invention to provide a circular accelerator which enables to keep a location of a beam as extracted from a transportation system substantially constant and a method and an apparatus for extracting the charged-particle beam.

It is a fourth object of the present invention to provide a circular accelerator which enables to keep a diameter of a beam as extracted from a transportation system substantially constant and a method and an apparatus for extracting the charged-particle beam.

It is a fifth object of the present invention to provide a circular accelerator which enables to control the extracting current and a method and an apparatus for extracting the charged-particle beam.

It is a sixth object of the present invention to provide a reduced size of an accelerator from which a beam is extracted.

In order to attain the first and second objects, means is provided for resonating the betatron oscillation of the charged-particle beam and additionally further means is provided for increasing the betatron oscillation amplitude of the charged-particle beam.

In order to attain the first to the fifth objects, means is provided for increasing the betatron oscillation amplitude of the charged-particle beam, while keeping the stability limit for the resonance of the betatron oscillations substantially constant.

In order to attain the fifth object, means is provided for controlling the degree in increasing of the betatron oscillation amplitude.

As the means for increasing the betatron oscillation amplitude, any one of the following means may be used.

(1) Applying a magnetic field varying with time to the beam, (2) Applying an electric field varying with time to the beam, (3) Causing particles different from the extracted beam to collide with the extracted beam.

In order to attain the first, the second and the sixth objects, the central position of the charged-particle beam is changed so as to gradually approach to the extracting deflector without the resonance due to the multipole magnet for the resonance excitation, and while the beam circulates several times, the beam is repetitively extracted from its end. For the purpose, any one of the following means may be used.

(4) Applying a high-frequency electro-magnetic field to the beam for changing the beam orbit gradient, (5) Applying a high-frequency electro-magnetic field to the beam for changing energy of the beam, (6) Changing a magnetic field of an electromagnet thereby changing the beam orbit gradient.

DESCRIPTION OF THE PREFERRED EMBODIMENTS

Figure 1:
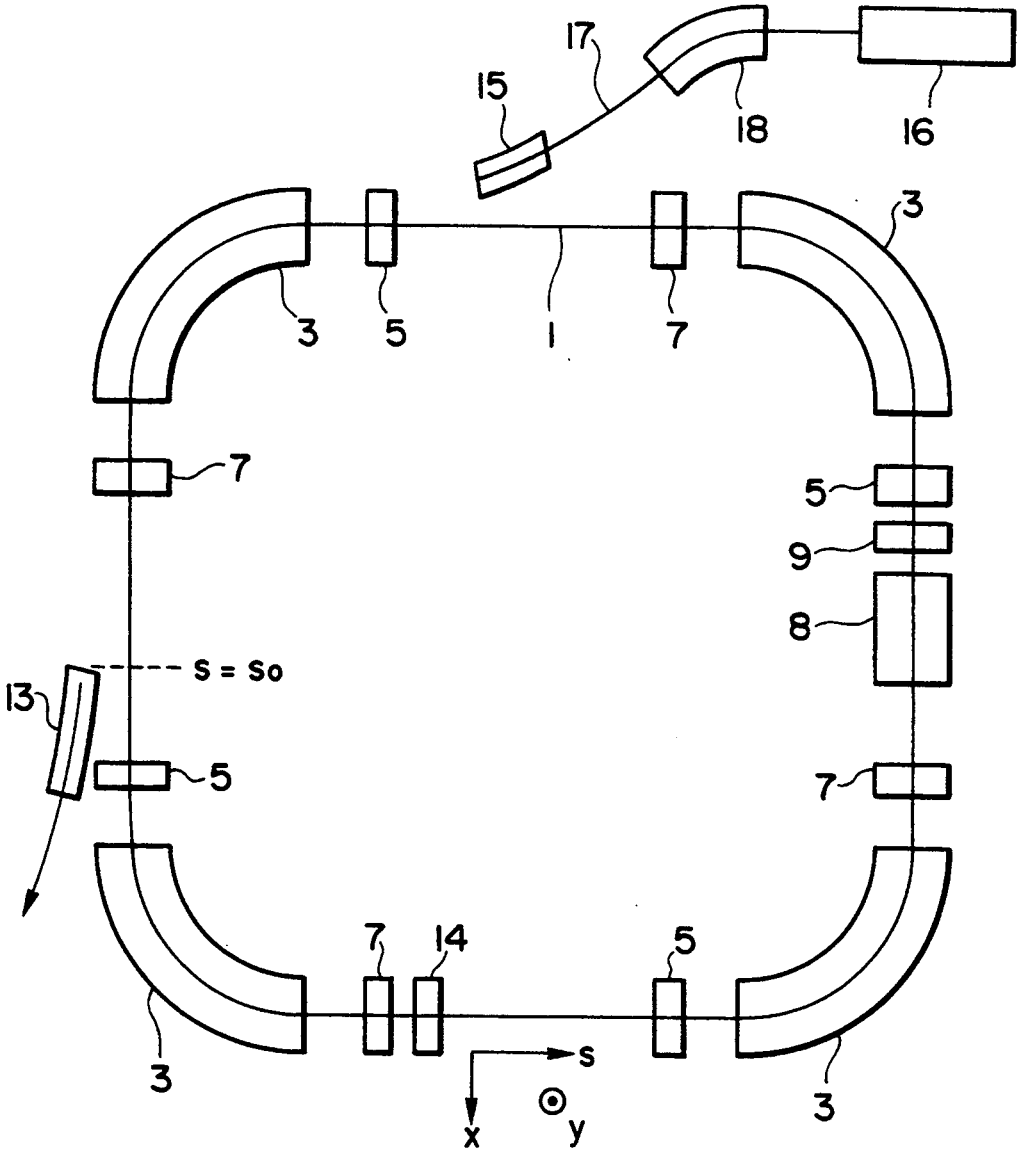
FIG. 1 is a view showing a circular accelerator according to a first embodiment of the invention.

FIG. 1 shows an arrangement of a circular accelerator according to a first embodiment of the invention. The circular accelerator serves to inject protons having 20 MeV energy, accelerate the protons up to 100 MeV and extract the accelerated protons. A beam 17 is injected from a pre-stage accelerator 16 into the accelerator through a beam transport line 18 and an injector 15. At the injector unit 15, the beam 17 is injected into the circular accelerator. The circular accelerator is arranged to have a high-frequency cavity 8 for feeding energy to the injected beam 17, a bending electromagnet 3 for bending a beam orbit, four-pole electromagnets 5 and 7 for controlling a betatron oscillation of the beam, a six-pole electromagnet 9 for exciting the resonance for extraction of the beam, an electrode device 14 for applying a time-variable magnetic field to the beam for increasing the betatron oscillation amplitude of particles within a stability limit for resonance, and an extracting deflector 13 for extracting the particles whose betatron oscillation amplitudes are increased into a beam transportation system for extraction. Of these devices, the six-pole electromagnet 9, the electrode device 14 for applying a time-variable magnetic field to a beam, and the extracting deflector 13 are used only at the extracting process after accelerating the beam up to a target energy.

Figure 3:
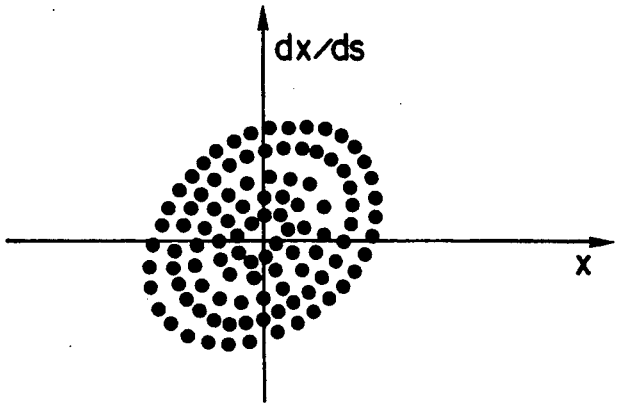
FIG. 3 is a diagram showing a phase space at injection and acceleration of the beam.

The beam injected by the injector 15 is curved by the deflecting electromagnet 3 while it is circulating. The quadrupole electromagnets 5 and 7 apply to the beam a force proportional to the deviation of the orbit of the beam from its desired path thereby changing its orbit gradient. That is, the four-pole electromagnet 5 serves to change an orbit gradient in a direction of converging the beam horizontally and the four-pole electromagnet 7 serves to change the orbit gradient in a direction of diverging the beam horizontally. With respect to the vertical direction, the four-pole electromagnet 5 serves to diverge the beam and the four-pole electromagnet 7 serves to converge the beam. By these electromagnets, the beam circulates along the designed orbit, while the number of betatron oscillations of the beam is controlled according to the magnitude of excitation of the converging and diverging quadrupole electromagnets. In order that the beam circulates stably when it is injected and accelerated, it is necessary to keep the number of betatron oscillations per one circulation (tune) at such a value as not causing any resonance, in particular, to separate the tune from a value which causes a resonance of low order. In this embodiment, the four-pole electromagnets 5 and 7 are adjusted so as to set the horizontal tune $\nu x$ as 1.73 and the vertical tune $\nu y$ as 1.23. In this state, the beam is able to stably circulate, the accelerator and the high-frequency accelerating cavity body 8 serves to apply energy to the beam. The frequency f to be applied to the high-frequency accelerating cavity 8 is a value integer (n) times of the frequency at which the beam is circulated. The beam, which is in a form of n blocks (bunches), circulates in the s direction in synchronizm with the high frequency f. While supplying an energy from the high-frequency cavity 8 to the beam, the bending electromagnets 3, and the four-pole electromagnets 5, 7 are controlled so as to increase their magnetic field intensities, while maintaining the proportions of the magnetic field intensities constant. As a result, at the bending electromagnet, the increase of the centrifugal force due to the increase of the beam energy is balanced with the increase of the centripetal force due to the increase of the excitation of the bending electromagnet, so that the beam circulates along a constant orbit. The orbit traces on the phase space (x, dx/ds) at the s-directional extracting port s=so in the balancing state are shown in FIG. 3. The orbit traces on the phase space shown in FIG. 3 look like a lot of similar ellipses with different diameters. The diameter of each ellipse corresponds to the magnitude of a betatron oscillation amplitude. In actual, the smaller diameter of each ellipse corresponds to the smaller magnitude of the betatron oscillation amplitude.

Figure 4:
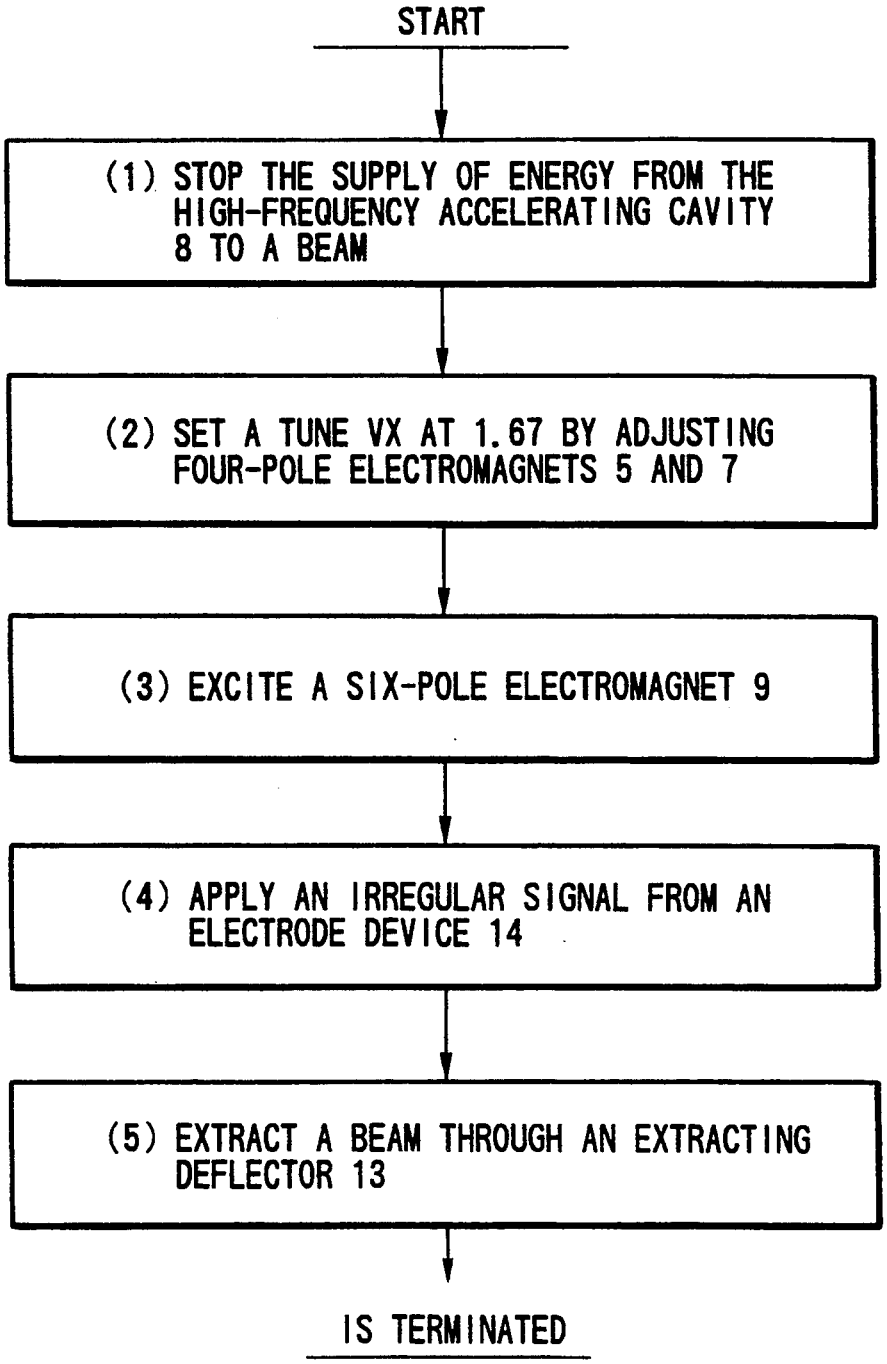
FIG. 4 is a flowchart showing a driving method executed when a beam is extracted in the first embodiment.
Figure 5:
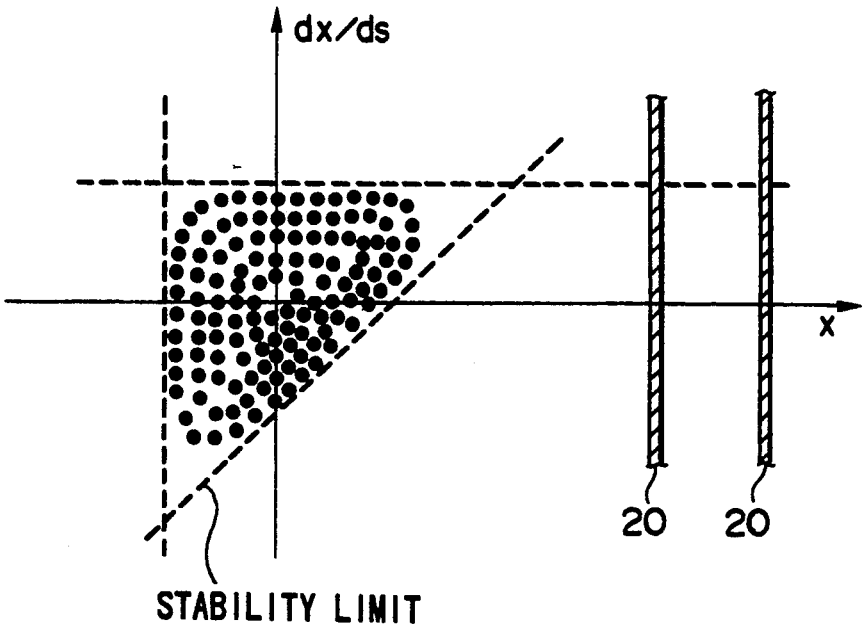
FIG. 5 is a diagram showing a phase space immediately before a beam is extracted in the first embodiment.
Figure 6:
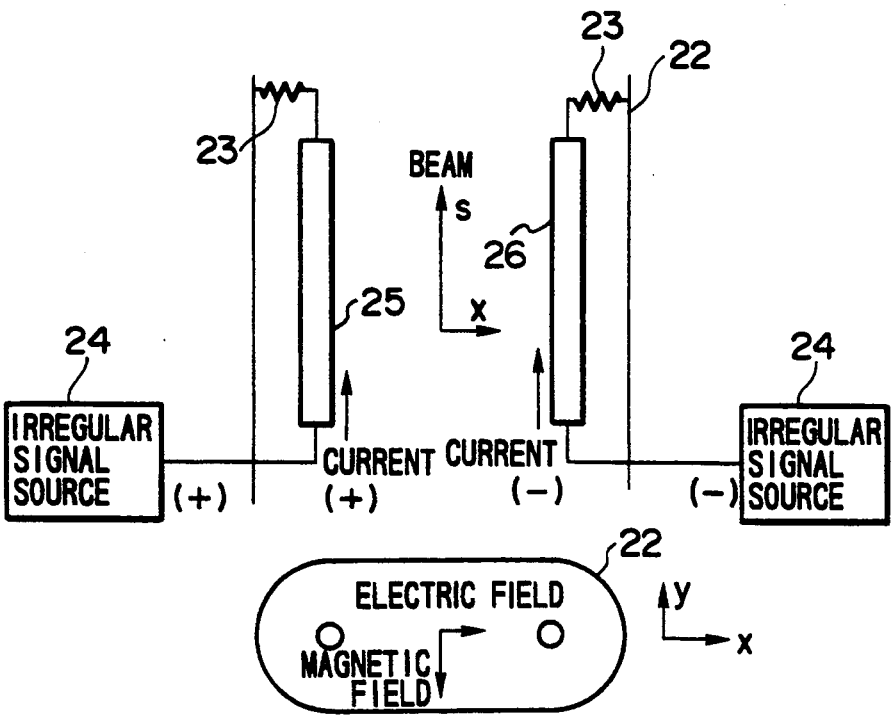
FIG. 6 is a view showing the structure of a high-frequency applying unit in the first embodiment.

The method of operation for extracting the beam after accelerated up to a target energy is shown in FIG. 4. As shown in the step (1), the supply of an energy from the high-frequency cavity 8 to the beam is stopped. As a result, the beam does not take a form of bunches but takes a form of continuous beam. Next, as shown in the step (2), the power supplies for the converging four-pole electromagnet 5 and the diverging four-pole electromagnet 7 are adjusted to set the horizontal tune $\nu x$ at 1.67. At the step (3), a current is supplied to the six-pole electromagnet 9 for excitation of resonance. The current supplied to the six-pole electromagnet 9 is set at such a value as keeping the particles having a large betatron oscillation amplitude in the circulated beam within the stability limit. This value is predetermined by calculation or a repetition of operations for extraction. The traces on the phase space at the extracting deflector 13 are shown in FIG. 5. The traces on the phase space are in a form of triangle. At the step (4), a time-variable irregular signal is applied from the high-frequency applying device i.e. electrode device 14 (see FIG. 1). FIG. 6 shows the structure of the electrodes 25, 26 in the high-frequency applying device 14. The electrodes 25, 26 shown in FIG. 6 are bar-like ones facing to each other in the horizontal direction for applying the time-variable irregular signal. The power supply 24 for irregular signal is connected to cause currents of opposite polarities to flow through the bar-like electrodes, respectively, so that a magnetic field and an electric field are applied in respective directions as shown in FIG. 6 to the beam. A load resistance 23 is connected so as to prevent the applied current from being reflected at the electrode end and returning to the power supply. By the effects of the magnetic field and the electric field, the orbit gradient of the beam changes so that the betatron oscillation amplitude of the beam within the phase space shown in FIG. 5 begins to increase. The particles exceeding the stability limit shown in FIG. 5 are extracted out of the deflector 13, because the amplitude of the betatron oscillation of those particles abruptly increase by resonance. Afterward, by applying the irregular signal to the electrodes 25, 26, the amplitude of the betatron oscillation of the particles gradually increase. Even the particles having small betatron oscillation amplitude at an initial stage exceed in a short time the stability limit shown in FIG. 5 and extracted through the extracting deflector 13. In the phase space shown in FIG. 5, the stability limit is constant, so that the orbit gradient dx/ds and a turn separation Ts of the extracted beam are both maintained in the extracting process. In this embodiment, the electrodes shown in FIG. 6 have been used. However, the same effects can be obtained by superposing a time-variable signal component on the current supplied to any one of the electromagnets provided in the circular accelerator or by providing an additional electromagnet for increasing the betatron oscillation of the particles within the stability limit of resonance in extraction of the beam and irregularly changing the current supplied to the electromagnet.

Next, the function of the first embodiment will be described as referring to the drawings.

FIG. 1 is a view showing a general construction of this invention, concretely, a circular accelerator for extracting the accelerated beam. The circular accelerator is arranged to have the bending electromagnet 3, the four-pole electromagnets 5, 7, and the extracting deflector 13. The electromagnet 9 serves to generate a multipole magnetic field for generating resonance. The coordinate system is arranged so that the beam circulating direction is s, the horizontal direction is x, and the vertical direction is y as shown in FIG. 1. The beam circulates along a designed circular orbit 1 while oscillating. The designed orbit 1 is normally determined to meet the center line of the vacuum duct. The amplitudes of betatron oscillation of respective particles composing the beam are generally different so that the beam contains particles having large amplitudes and those having small amplitudes. Thus, the beam diameter circulating the designed orbit 1 is determined by the maximum value of the betatron oscillation amplitude. As mentioned above, the number of betatron oscillations per one circulation is referred to as a tune. It is assumed that a horizontal tune is $\nu x$ and a vertical tune is $\nu y$. The values of the horizontal tune $\nu x$ and the vertical tune $\nu y$ are adjusted by the magnitude of excitation of the converging four-pole electromagnet 5 and that of the diverging four-pole electromagnet 7. The s-directional length of the beam is 1/10 to $\frac{1}{4}$ of the circumferential length of the accelerator. The beam is circulated in a form of plural bunches.

By adjusting the excitations of the four-pole electromagnets 5 and 7 so as to cause, the horizontal tune $\nu x$ or the vertical tune $\nu x$ to approach an integer $\pm p/q$ (irreducible fraction), and exciting the resonant-exciting electromagnet 9, the particles having the betatron oscillation amplitude exceeding the stability limit are caused to increase the amplitudes thereof by the effect of resonance. The resonance at this time is referred to as a q-th order resonance. The invention will be explained hereinafter with respect to an example in which the beam is extracted in the horizontal direction by the third-order resonance.

Figure 2:
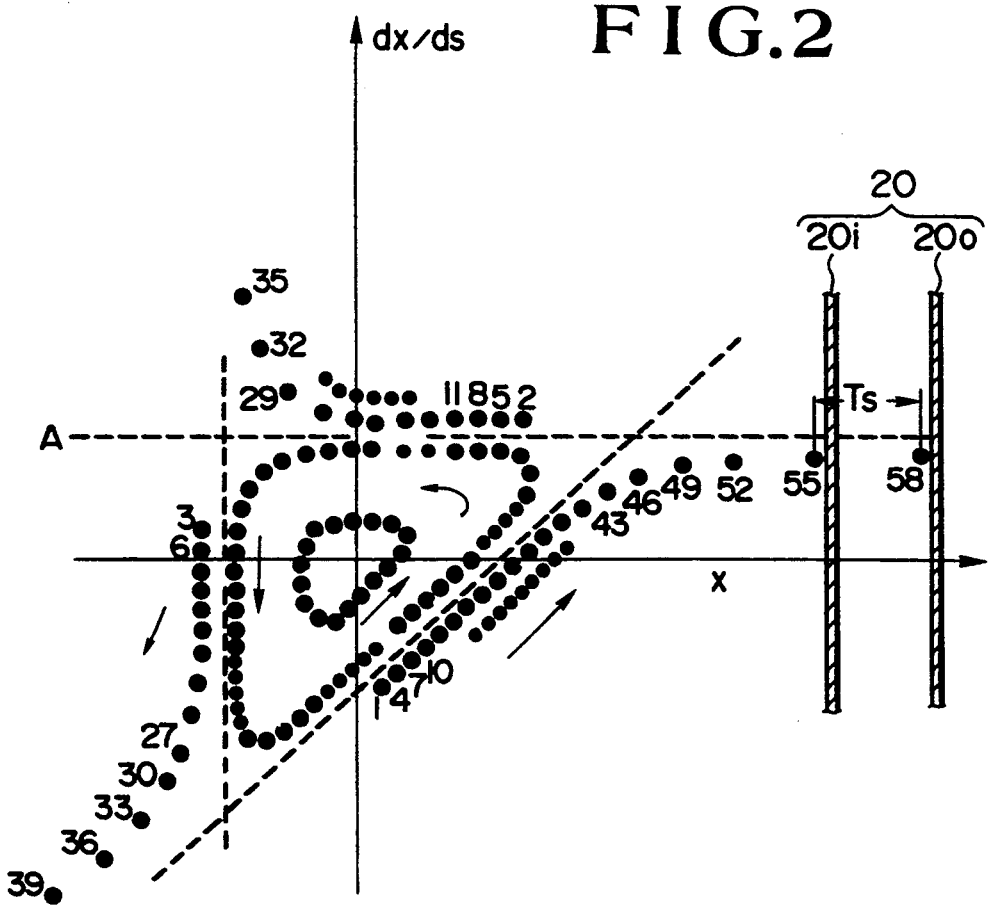
FIG. 2 is a diagram showing the stability limit at the phase space.

By adjusting the four-pole electromagnets 5 and 7 so as to cause, the horizontal tune $\nu x$ to approach a value of an integer $\pm\frac{1}{3}$ and exciting the multi-pole electromagnet 9 (six-pole electromagnet is used in the case of the third-order resonance), the third-order resonance is activated on the particles having large oscillation amplitudes. FIG. 2 shows a relation between x and dx/ds (phase space) in each circulation of the beam at an s-directional location s =so where the extracting deflector 13 shown in FIG. 1 is installed. The broken line shown in FIG. 2 indicates a range of stability limit in the phase space. The particles outside of the range of stability limit, that is, the particles having larger betatron oscillation amplitudes than a limited value are caused due to the effect of the resonance to increase the oscillation amplitudes thereof each time they make one circulation of the orbit 1. The numbers marked to the particles exceeding the stability limit shown in FIG. 2 indicate the number of circulations. As the stability limit is made smaller as the deviation of the tune $\nu x$ from an integer $\pm p/q$ is made smaller or the strength of the multi-pole magnetic field for generating resonance is made larger. In FIG. 2, 20 denotes electrodes of the extracting deflector 13. If the particles collide with the electrode 20, they disappear. If the particles enter into the area between the electrodes 20, they are extracted out of the circular accelerator.

The orbit gradient dx/ds of the particles at the deflector is substantially equal to A, as shown in FIG. 2, which is set at, for example, an angle formed between the circulating orbit and the extracting deflector. The diameter of the beam as extracted out of the transportation system is determined by the diameter of the beam entered into the extracting deflector. In the case of the third-order resonance, the increment of deviation per three circulations of the particles exceeding the stability limit (the increment per q circulations in the case of q-th-order resonance) is referred to as a turn separation Ts. The value of "Ts" of a particle becomes larger, as the deviation of the particle from the stability limit becomes larger. Therefore, in order to extract particles having small betatron oscillation amplitudes, if the tune is changed so as to lower the stability limit like the prior art, the turn separation Ts is also made smaller, resulting in that when the stability limit is reduced to a given value, the particles can not exceed the inner wall **20*i*** of the extracting deflector. Assuming that the thickness of the wall of the extracting deflector is t, the rate of the extracted particles is (Ts−t)/Ts in the primary evaluation. Hence, as the stability limit is made smaller, the utilization efficiency becomes lower. In general, the distribution of the circulating beam becomes larger as the betatron oscillation amplitude becomes smaller. The influence is further increased.

According to the present invention, the stability limit is selected to ensure at least the required turn separation value so that the betatron oscillation amplitudes of the charged particles within stability limit are made larger thereby shifting them outside of the stability limit. As a result, even the particles having small betatron oscillation amplitudes, which could not be extracted heretofore without lowering the stability limit, can be extracted while keeping the required value of the turn separation Ts. The present invention, therefore, can offer the circular accelerator having a high extracting rate or extracting current and a method and an apparatus for extracting the charged-particle beam.

Next, the description will be directed to the function realized by keeping the stability limit for the resonance substantially constant. As described hereinbefore, the stability limit for resonance is controlled by adjusting the tune and the excitation of the multipole electromagnet for generating resonance. FIG. 2 shows traces of the typical particles on the phase space. The other particles move between the shown traces. That is, many particles exist between the orbit traces as shown in FIG. 2. Among the beams of which the amplitudes of oscillations are increased, those beams which enter between two electrodes **20*i* and 20*o*** of the extracting deflector are extracted. Therefore, by maintaining the stability limit constant, it is possible not only to keep the gradient of the ectracted beam, or the extracting angle constant, but also to keep the diameter and the position of the extracted beam constant. When the position of the extracted beam and the turn separation Ts are both made constant, the extraction efficiency (Ts−Td)/Ts becomes also constant. Because the gradient of the extracted beam and the turn separation Ts can be changed by the tune selection which is made when setting the stability limit value before extracting the beam, that is, by adjusting the excitation of the quadrupole electromagnet and the electromagnet for generating resonance, it is possible to achieve a large and constant value of the extraction efficiency.

Figure 31:
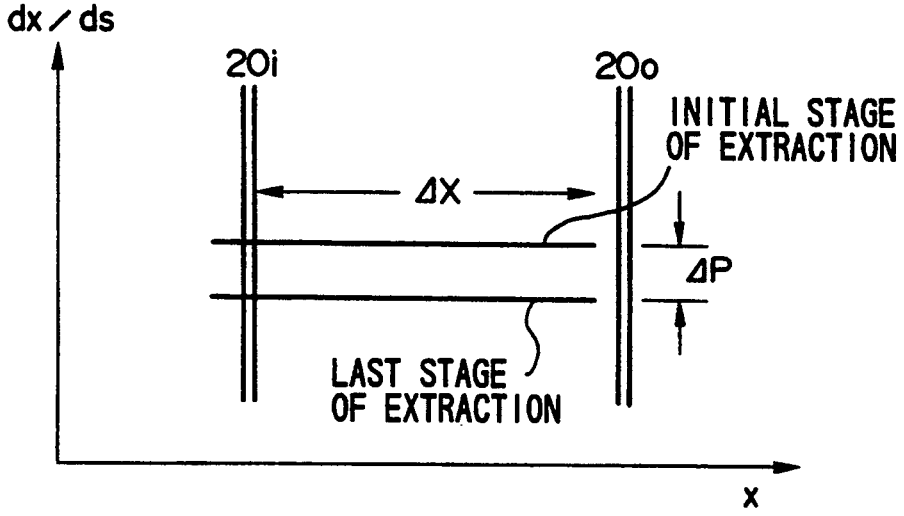
FIG. 31 is a diagram showing the electrodes of the extracting deflector in the first embodiment.

Next, emittance representing the beam characteristics will be explained. The beam emittance indicates an area on the phase space occupied by the beam and is proportional to a product of the beam size and a width in distribution of the orbit gradient. For example, the emittance of the beam which circulates within the stability limit for resonance on the phase space as shown in FIG. 5 is equal to an area surrounded by broken lines. On the other hand, the phase space of the extracted beam in the vicinity of the electrode 20 of the extracting deflector is shown in FIG. 31. The emittance of the extracted beam is equal to a product of the width $\Delta X$ of the beam entered between the electrodes **20*i* and 20*o* of the deflector and the variation ΔP of the orbit gradient. When the resonance is generated while maintaining the stability limit for resonance substantially constant, the variation ΔP of the orbit gradient as shown in FIG. 31** is negligibly small so that the emittance of the extracted beam can be set to a constant small value.

Next, the description will be directed to how to increase the betatron oscillation of the particles within the stability limit for resonance. For increasing the oscillation amplitudes of the particles within the stability limit, the three methods may be used as described with "Summary of the Invention".

For the magnetic field of (1), when the extracting plane is horizontal, the magnetic field is applied in the vertical direction (y direction) and when the extracting plane is vertical, the magnetic field is applied in the horizontal direction (x direction). This is done for changing the orbit gradient of the beam by the effect of the magnetic field. Though the change of the orbit gradient per one circulation is small, the accumulated changes are effective to make the beam oscillation amplitude larger. The time-variation of the magnetic field may be regular or irregular. A device for applying a magnetic field onto the beam may be an electromagnet, parallel linear or plane electrodes or an arc electrode. By applying the time-variable current to those devices, a time-variable magnetic field is applied to the beam, thereby increasing the amplitude of the betatron oscillation.

For an electric field of (2), the electric field is applied in the direction of the beam circulation, that is, in the s-direction. Or, when the extracting plane is horizontal, the electric field is applied in the horizontal direction (x direction) and when the extracting plane is vertical, the electric field is applied in the vertical direction (y direction). When the electric field is applied to the beam in the s-direction, the energy of the beam changes. The change of the beam energy results in changing the curvature radius of the orbit at the location of the bending electromagnet, thereby changing the position of the orbit of the center of the betatron oscillation, resulting in the change of the betatron oscillation amplitude. When the electric field is applied in the x direction or the y direction, like the magnetic field (1), a force is applied laterally to the beam and the orbit gradient is changed so that the betatron oscillation amplitude is increased. The time-variation of the electric field may be regular or irregular. The electric field is applied by supplying a tune-variable current to parallel linear or plane electrodes, or an arc electrode. Or, a time-variable voltage is applied to a button-like electrode or a plane electrode. As another means, a high frequency is applied to the high frequency cavity. Hence, in the case of the electric field, the electric field is divided into a component of the s-direction, and a component of the x-direction or the y-direction, whichever direction the electric field is applied. This results in realizing the foregoing two functions, thereby increasing the betatron oscillation amplitude.

If a time-variable signal is applied to the electrode or the cavity, both the electric field and the magnetic field are produced. Hence, when the magnetic field is used, the effect of the electric field may be superposed or when the electric field is used, the magnetic field is superposed. In any case, the betatron oscillation amplitude is increased, so that the beam can be extracted as in the case of using only one of the electric field and the magnetic field.

When a time variant electric or magnetic field is applied to the beam in a direction perpendicular to the beam moving direction, as above-mentioned, in order to increase the amplitude of betatron oscillations of the beam, it is desired that the magnetic or electric field includes a frequency component synchronized with the betatron oscillations, because, by applying such an electric or magnetic field to the beam, the electromagnetic field is substantially synchronized with the betatron oscillations and the amplitude of the betatron oscillations is effectively increased. The frequency of electromagnetic field synchronized with the betatron oscillations can be determined by multiplying a fraction of the value of tune or a value derived by subtracting a fraction of the value of tune from 1 by a circulating frequency of the beam. To generate the resonance for extracting the beam, it is necessary to provide a multipole electromagnet. By exciting the multipole electromagnet, the tune of the beam changes depending on the amplitude of the betatron oscillations. That is, the tune of the beam having a larger amplitude of the betatron oscillations is different from the tune of the beam having a smaller amplitude of the betatron oscillations. Further, the amplitudes of the betatron oscillations of the beam are continuously distributed from a large value to an infinitely small value and hence the tune values of the beam are also continuously distributed. Therefore, by using an externally applied electric field having frequency components distributed similarly to the distribution of the tune values of the beam, it is possible to efficiently increase the betatron oscillations. Especially, since the tune values of the beam are continuously distributed as above-mentioned, it is preferable to use an electromagnetic field of noise including a continuous frequency spectrum which includes a frequency approximately synchronized with the betatron oscillation. However, it is possible to increase the amplitude of the betatron oscillation by using an electro-magnetic field of a single frequency component which is almost equal to the distributed tune of the beam. In this case, a higher intensity of the electromagnetic field is required as compared with the case where the electromagnetic field including various frequency components are used.

The use of the electro-magnetic field including noises as the externally applied electromagnetic field provides another advantageous effect. That is, assuming that the current flowing through the electromagnet of the accelerator includes a ripple component, the tune changes with a lapse of time in synchronism with the ripple, resulting in change of the separatrix size as shown in FIG. 5. Therefore, in the conventional extracting method in which the separatrix size as shown in FIG. 5 is gradually decreased, it is very possible that the beam is extracted intermittently, because the stability limit value will be decreased while oscillating in synchronism with the ripple. On the other hand, if an electromagnetic field of which the intensity changes randomly is applied to the beam, the beam will be diffused in the phase space as shown in FIG. 5 and the amplitude of the betatron oscillation is increased. In this case, assuming that the variation of the amplitude of the betatron oscillation by noises is ΔAn, D is a constant and t is a time, the following relationship is established:

$$(\Delta An^2) = D\,t,$$

where $(\Delta An^2)$ is an average of variations of the amplitudes of the betatron oscillations of the whole particles.

From this, the time differentiation of the variation of the oscillations of the beam is given by 0.5 $(D/t)^{0.5}$. Thus, the rate in increasing of the oscillation in a short time is large but the rate in increasing of the oscillation in a longer time becomes small. Therefore, when the amplitude of oscillations of the beam is increased very gradually for a longer time interval, the increment of the amplitude of the betatron oscillation can be made larger than the variation of the stability limit value in a short time like one cycle of the ripple so that it is possible to extract the beam with substantially no affect of the ripple component of the power source.

For a method of (3), particles different from the beam circulating in the circular accelerator are injected into the circular accelerator so that the different particles collide with the circulating beam. The scattering of the particles caused by the collision results in changing the orbit gradient and increasing the betatron oscillation of the circulating beam. The different particles may be neutral or charged ones. The particles may be injected as gas or formed as a thin film disposed in the accelerator so that the beam collides with the thin film.

Next, the description will be directed to the function of the means for controlling the rate in increasing of a betatron oscillation amplitude. The extracting current can be adjusted by the number of particles exceeding the stability limit of the resonance for extraction, that is, the rate in increasing of the betatron oscillation amplitude of the particle within the stability limit. To increase the amplitude of the betatron oscillation by using the electric field (1) or (2), it is necessary to change the intensity of a time-variable signal to be applied to the electrodes thereby changing the intensity of the electric field or the magnetic field. To increase the extracting current for rapidly extracting the beam, the intensity of the time-variable signal is made larger. To decrease the extracting current by slowly extracting the beam, the intensity of the time-variable signal is made smaller. With the similar method, the current may be changed from time to time. To keep the extracting current constant, the rate in increasing of the oscillation amplitude is adjusted to meet the distribution of the circulating beam orbit.

The amount of the beam extracted per a unit time is almost proportional to the number of the particles of the beam circulating the accelerator. Hence, to extract the beam at a constant rate, as compared to the initial stage of the beam firing, the intensity of the electromagnetic field is required to make larger at the later stage of the extracting process than at the initial stage thereof. Since the extracting current can be controlled by the rate in increasing of the betatron oscillation amplitude, the start and the stop of the beam extraction can be controlled by starting and stopping the application of the electromagnetic field. As a result, the beam extraction can be started or stopped according to a predetermined schedule or a request of a user of the extracted beam. Further, the beam firing can be urgently stopped.

For using a method of (3), by adjusting the number of other particles to be injected into the circular accelerator, the adjustment can be made similarly to the case of increasing the betatron oscillation amplitude by the effect of the electromagnetic field.

As another method for controlling the extracting current, it is possible to change the stability limit by adjusting the tune or by changing the excitation of the electromagnet for generating resonance.

It is possible to change the gradient of the extracted beam and the turn separation Ts, by selecting the tune for setting the stability limit before extracting the beam, that is, adjusting the excitation of the four-pole electromagnet and that of the electromagnet for generating resonance.

Figure 20:
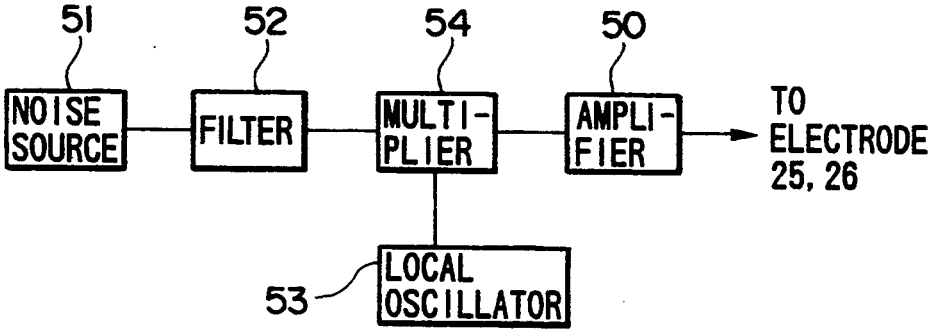
FIG. 20 is a block diagram showing a construction of the irregular signal source as shown in FIG. 6.

In the foregoing embodiment, the tune of the beam having a very small betatron oscillation amplitude is at a value of 1.67 set by the four-pole electromagnet. By the effect of the multi-pole electromagnet for generating resonance, the tune of the particle having a large betatron oscillation amplitude near the ceparatrics is shifted from the above value by $0.003=1.67-1.6666$ and the tunes of the beams having the oscillation amplitudes between them are continuously distributed between 1.67 and 1.6666. On the other hand, as described above, to increase the betatron oscillation amplitude of the beam, it is preferable to make the frequency components of the electric field almost equal to the tune distribution of the beam. The irregular signal source 24 shown in FIG. 6 may be noises having a very wide frequency spectrum or may have a frequency spectrum having a frequency band of about 0.65 to 0.70 times as large as the circulating frequency or integer-times thereof. In this case, the arrangement of the irregular signal source is shown in FIG. 20. As shown in FIG. 20, 51 denotes a noise source having an infinite frequency spectrum. 52 denotes a filter. The signal produced by the noise source 51 is passed through the filter 52 which allows the frequency components ranging from 0 to 0.025 times of the beam circulating frequency to pass therethrough. 53 denotes a local oscillator. The local oscillator 52 generates a frequency which is 0.675 time of the beam circulating frequency. The signal generated by the local oscillator is multiplied by the output signal of the filter 52 in a multiplier 54. The resultant product is an irregular signal having a frequency spectrum in the range of 0.65 to 0.7 time of the beam circulating frequency. The signal having the necessary frequency spectrum may be produced, without using the local oscillator 53, by changing the frequency pass-range of the filter 52. Further, in this embodiment, it is possible to extract the beam at a constant current without receiving the affect of the ripple component included in the power source current applied to the electromagnets by using an irregular signal as external noises to the beam thereby diffusing the beam inside the phase space.

Figure 21:
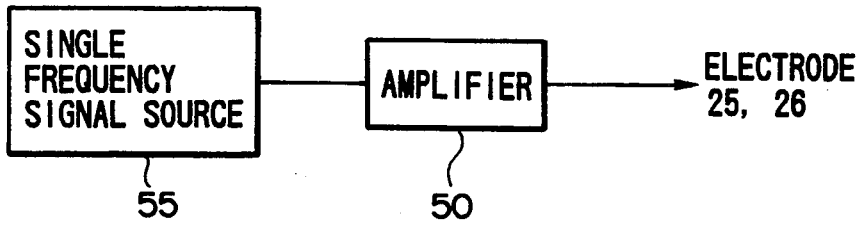
FIG. 21 is a block diagram showing a construction of the single frequency source in the second embodiment.

Next, the description will be directed to a second embodiment of the invention. The second embodiment has the same arrangement as the first embodiment except that a regular signal is applied to the electrodes. The method of operation for extracting the beam is the same as that shown in FIG. 4. In place of the irregular signal source 24, an a.c. signal source 55 for generating a single frequency f as shown in FIG. 21 is used to apply an a.c. signal having the frequency f to the electrodes 25 and 26. The frequency f is equal to a product of the beam circulating frequency Frev and a fraction from an integer of the tune at extraction of the beam, that is, $(1-0.67=)$ 0.33. By applying a signal having such a frequency, the period of the external signal applied through the electrodes is substantially equal to the period of the betatron oscillation. As a result, the particles within the stability limit as shown in FIG. 5 are caused to increase the amplitude of the betatron oscillation thereof beyond the stability limit for extraction shown in FIG. 5. This makes it possible to extract the beam like the first embodiment. When an a.c. signal having a single frequency is applied, the resonance takes place in the particles having a tune synchronized with the frequency by the effect of the external signal. This results in rapidly increasing the oscillation amplitude, so that the beam is extracted in a short time. However, many particles which undergo no resonance with the external signal are delayed for extraction from the resonant particles.

Figure 22:
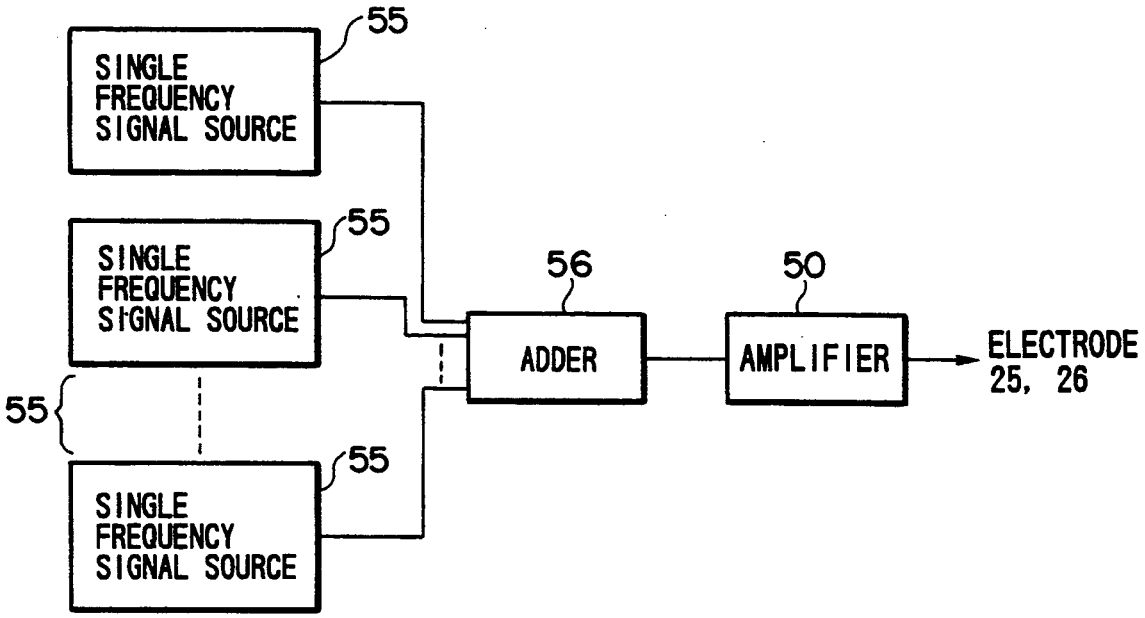
FIG. 22 is a block diagram showing a construction of plural-frequency signal source in the second embodiment.

The second embodiment utilizes the disturbance of the signal frequency shown in FIG. 21. As shown in FIG. 22, a plurality of signal sources, each generating a signal frequency, may be provided so that a plurality of frequencies f1, f2, . . . fn are applied to the electrodes 25 and 26 through an adder 56. As compared with the use of the disturbance of the single frequency, the use of the plurality of frequencies makes it easier to extract a beam having a broader range of tune. In this case, it is preferable to keep the frequency of the applied signal near a selected tune in the range.

In the first and the second embodiments, signals of opposite polarities are applied to two electrodes 25, 26, respectively, as shown in FIG. 6. This results in applying an electric field and a magnetic field to the beam, thereby changing the orbit gradient. On the other hand, when signals of the same polarity are applied to the electrode, an electric field is produces in the s-direction at the s-directional end of each of the electrodes 25, 26. This results in accelerating or decelerating the beam, thereby changing the orbit gradient of the beam and increasing the betatron oscillation amplitude of the beam. The electrode may be a bar-like one or a plate one. When applying signals of opposite polarities to two electrodes, it is possible to generate an electric field in the x direction or the y direction by making the electrodes small disc-like. In general, by applying a time-variable signal to metal electrodes, it is possible to generate an electromagnetic field and change the orbit gradient of the beam, thereby increasing the betatron oscillation amplitude of the beam.

Figure 7:
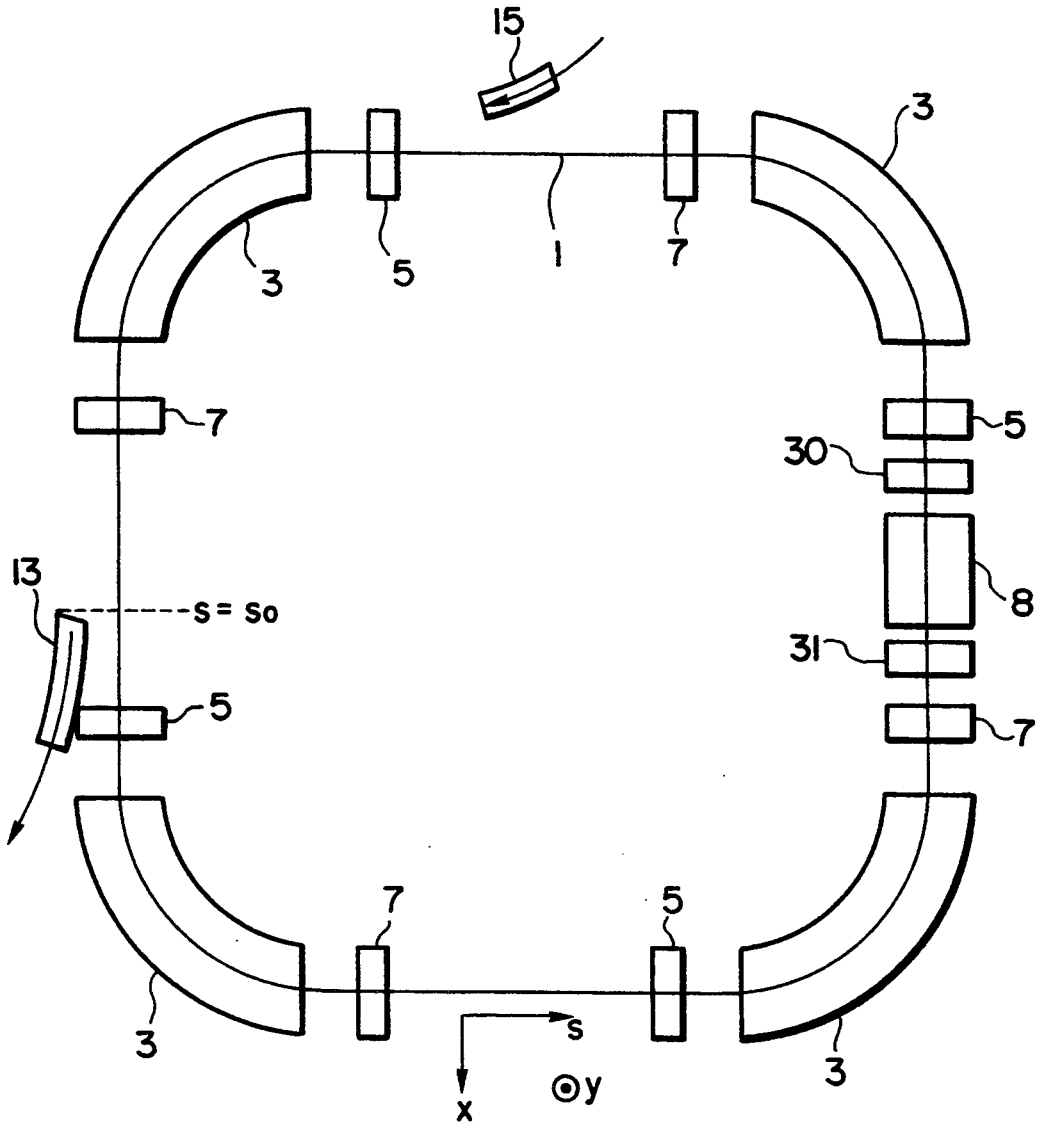
FIG. 7 is a view showing an accelerator according to a third embodiment of the invention.
Figure 8:
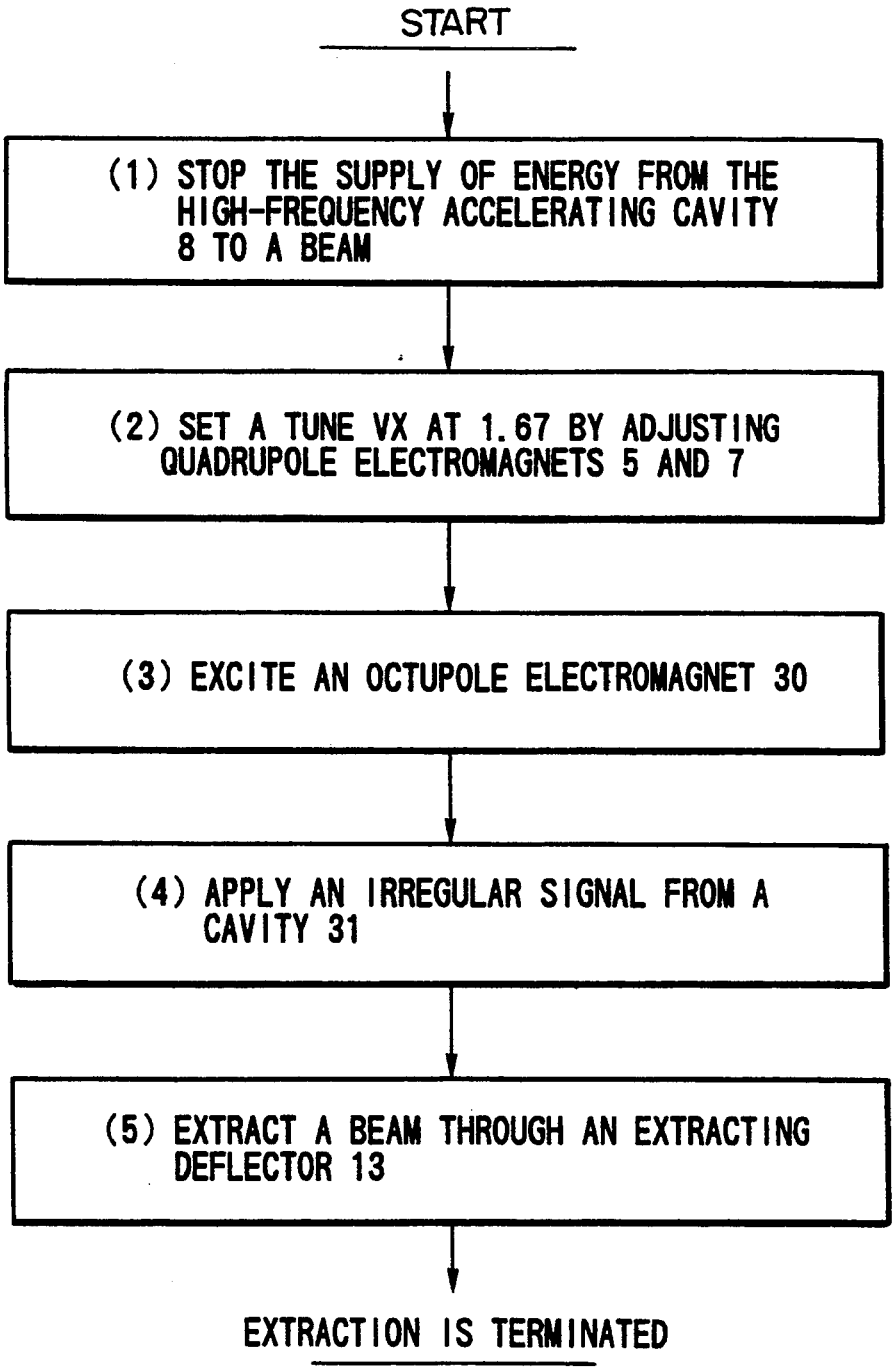
FIG. 8 is a flowchart showing a driving method executed in the third embodiment.
Figure 9:
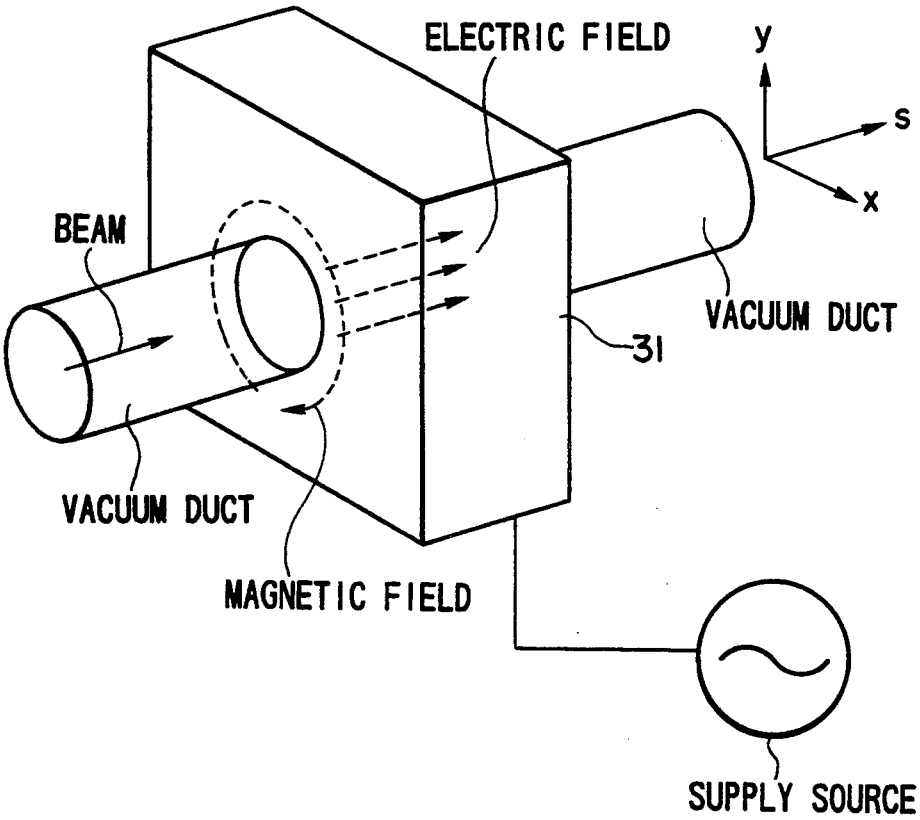
FIG. 9 is a view showing a cavity for applying a high frequency to the beam for increasing an amplitude of its betatron oscillation in the third embodiment.

Next, the description will be directed to a third embodiment of the invention. The arrangement of the third embodiment is shown in FIG. 7. This embodiment is different from the first embodiment shown in FIG. 1 in that an octupole electromagnet 30 is used as the multipole electromagnet for exciting the second order resonance (half ($\frac{1}{2}$) integer resonance) for extracting the beam and a cavity 31 for applying a high frequency is used for increasing the amplitude of the betatron oscillation of the particles within the stability limit of the resonance. The cavity 31 is provided in addition to the cavity 8 for accelerating a beam from a low energy to a high energy. The method of operation of the third embodiment after accelerating the beam up to a predetermined energy level is shown in FIG. 8. After accelerating the beam, at a step (1) of FIG. 8, the cavity 8 is made in active. Then, at a step (2) of FIG. 8, a converging four-pole electromagnet 5 and a diverging four-pole electromagnet 7 are adjusted so as to make the horizontal tune $\nu x$ closer to 1.55. Then, the octupole electromagnet 30 is excited. The field intensity of the octupole electromagnet is adjusted such that the particles stably circulate while betatron-oscillating with different amplitudes. The time-variable irregular signal is applied to the high frequency application cavity 31. The cavity 31, as shown in FIG. 9, produces an electric field in the direction (s) of the beam circulation and a magnetic field in the vertical (y) direction. In the cavity, the orbit gradient of the beam irregularly changes each time the beam circulates so that the particles sequentially exceed the stability limit in the order of larger to smaller magnitude of the initial betatron oscillation amplitude, resulting in extraction of the beam through the extracting deflector 13. By applying the irregular signal by the cavity 31, even the particles having smaller initial betatron oscillation amplitudes are caused to increase their amplitudes to exceed the stability limit, and finally extracted in the same manner as that in the first embodiment.

Figure 10:
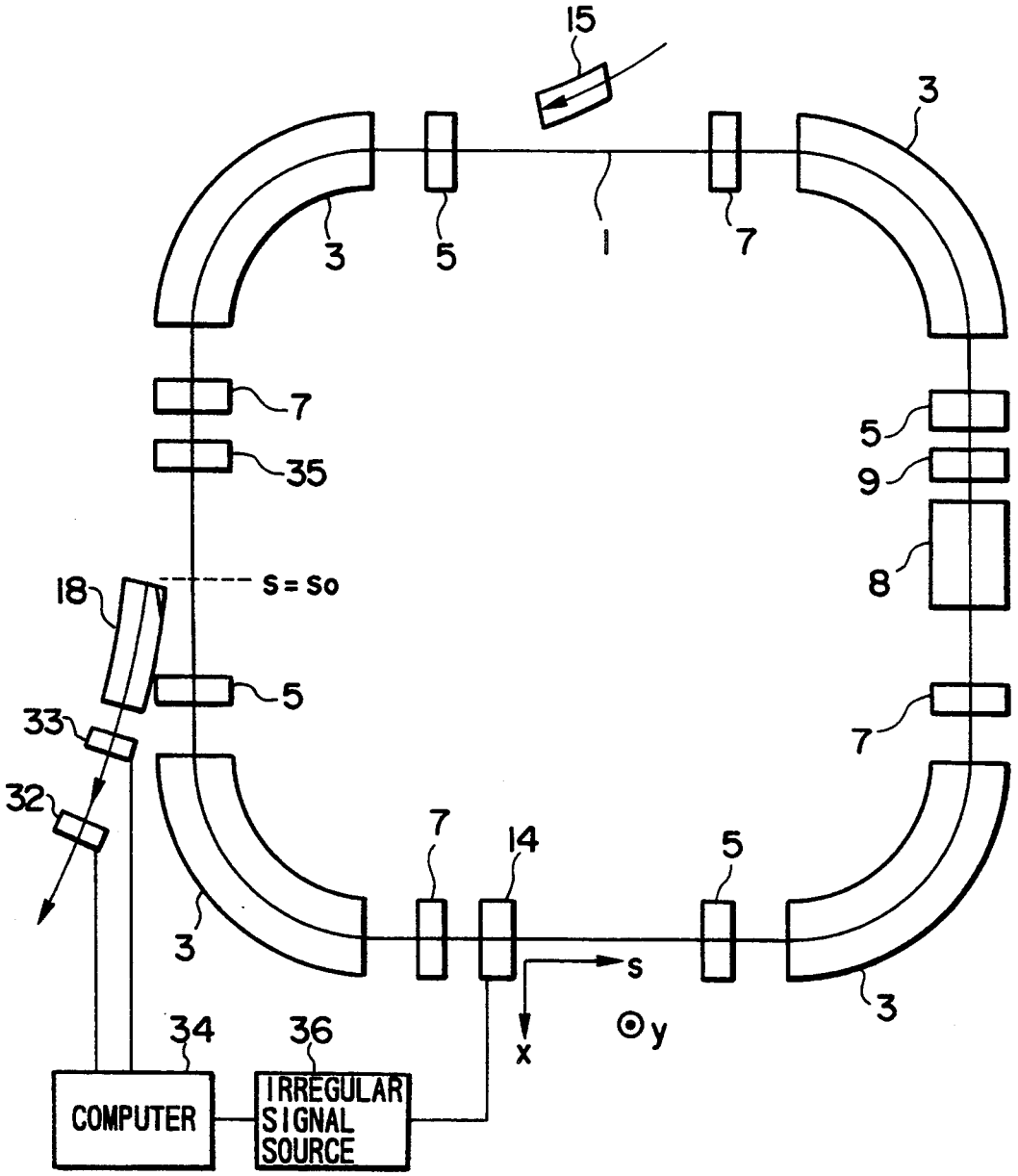
FIG. 10 is a view showing an accelerator according to a fourth embodiment of the invention.
Figure 11:
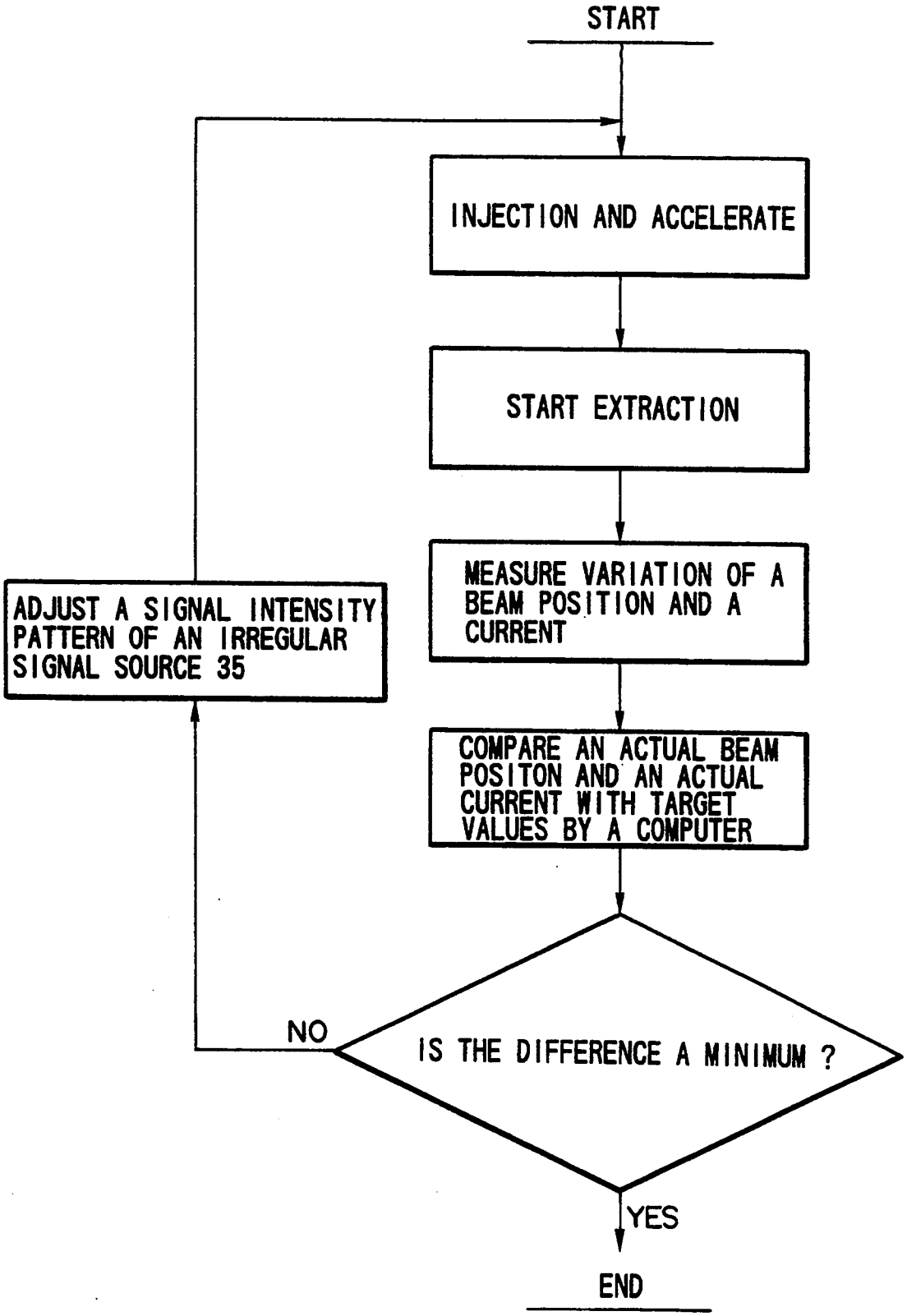
FIG. 11 is a flowchart showing a driving method executed in the fourth embodiment.

Next, the description will be directed to a fourth embodiment of the invention. This embodiment is relating to a method of adjusting a position and a current of a beam as extracted. The construction of the fourth embodiment is shown in FIG. 10. In addition to the construction of the first embodiment, there are provided an electromagnet 35 for correcting an orbit of the extracted beam, a beam position measuring unit 32, a current measuring unit 33 and a control computer 34, the last three of which are disposed in the extraction section. The method of driving the system of the fourth embodiment is shown in FIG. 11. In this embodiment, the intensity of a time-variable irregular signal, which is applied to the high-frequency applying unit 14, is controlled according to a pattern preliminarily stored in the control computer 34. The pattern of the signal intensity stored in the control computer 34 is renewed each one drive cycle including injection, acceleration and extraction of the beam carried out in that order. The method of injection, acceleration and extraction of the beam is the same as that shown in FIG. 4. The patter of the intensity of the signal applied to the high-frequency applying unit 14 is determined so as to make minimum the difference between a target beam position preliminarily stored in the computer and an actual beam position measured by the beam position measuring unit 32 and also make minimum the difference between a target time-variable beam current and an actual beam current measured by the beam current measuring unit 33.

For a pattern of repeating the extraction and the interruption of the current, the target beam current can be easily realized by activating and deactivating means for increasing the betatron oscillation amplitude.

The present embodiment is realized to change the pattern of the intensity of the high frequency signal by using the beam measuring unit thereby obtaining a desired characteristic. Without the beam measuring unit, however, by increasing the intensity of the signal applied from the high frequency applying unit 14 progressively from the initial stage to the last stage of extraction, it is possible to extract a beam with a constant current. This is because, at initial extraction stage, there are many particles having larger betatron oscillation amplitudes which are extracted by a signal of lower intensity, while, at the extraction last stage, the number of the circulating particles decreases. Then, in order to obtain a constant extracting current, it is necessary to increase the rate in increasing of the betatron oscillation amplitude of the beam. By preliminarily determining a target pattern of the intensity of the time-variable high frequency signal, therefore, it is possible to realize the target pattern in a short time by the driving method as shown in FIG. 11.

In order to obtain a target beam characteristic, this embodiment is arranged to adjust only the intensity of the signal to be applied to the high-frequency applying unit 14. However, the same effect may be obtained by adjusting a frequency and a frequency spectrum of a high-frequency signal, or additionally adjusting a magnitude of the resonance stability limit, that is, by adjusting the tune by the quadrupole electromagnet and the field intensity of the multi-pole electromagnet 9 for exciting resonance or by using other electromagnets such as the deflecting electromagnet 3 and the orbit-correcting electromagnet 35.

Figure 23:
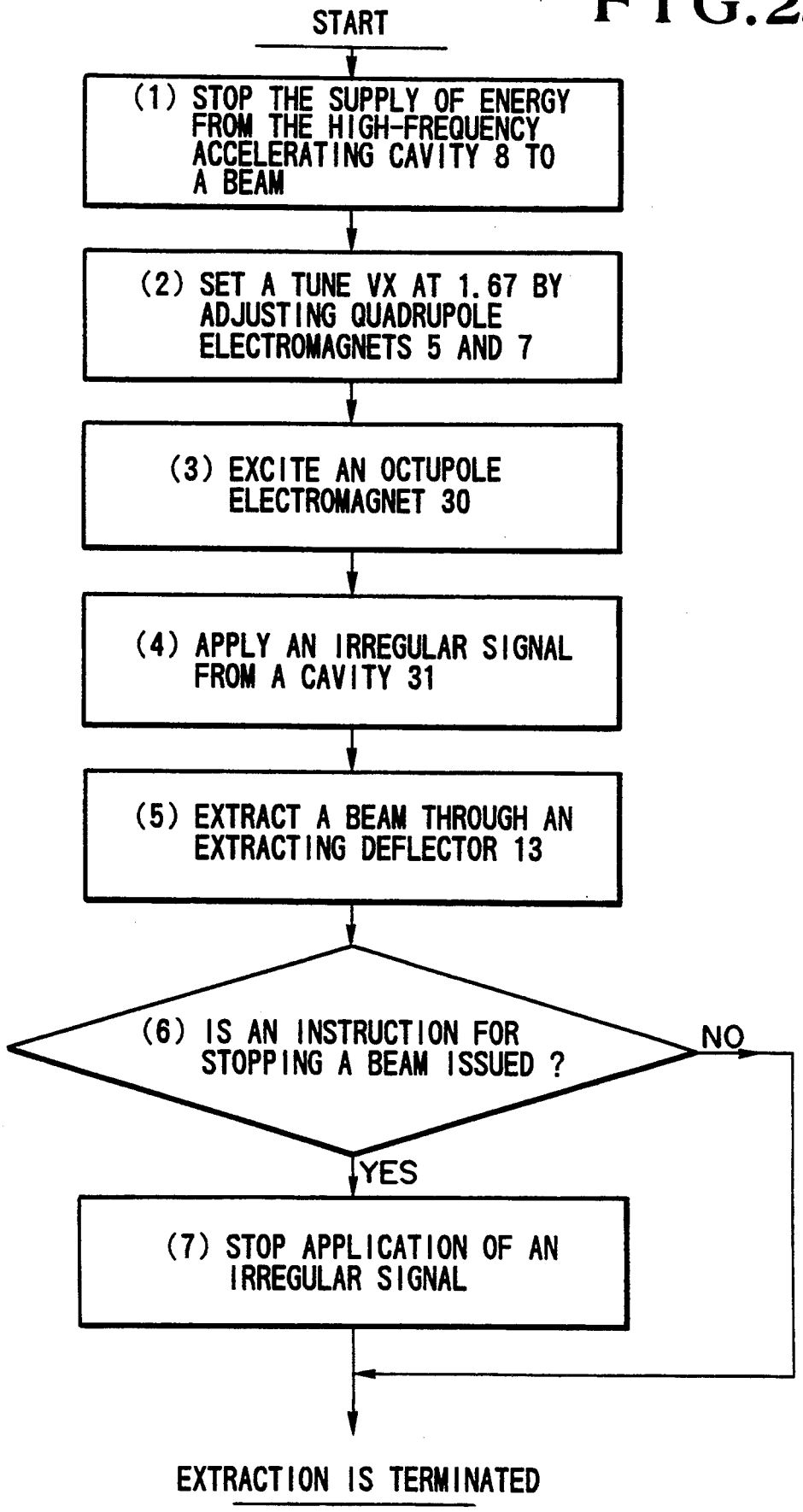
FIG. 23 is a flowchart showing a driving method executed in a fifth embodiment of the invention.

The foregoing embodiment is relating to the control of a beam as extracted in a normal driving mode. FIG. 23 shows the fifth embodiment relating to a method of emergency stoppage of the beam extraction. The steps (1) to (5) of FIG. 23 are for the normal driving, and the same as those shown in FIG. 4. At the step (6), it is judged whether or not there exists a stop signal sent from a system using the extracted beam or an emergency stop signal sent from any one of various safety systems. If the stop signal exists, the high-frequency signal is stopped for stopping extraction of the beam. Since the high-frequency signal for extracting a beam can stopped in several micro seconds, the extraction of the beam is stopped without failure in a very short time. If the stop of the high-frequency signal and the change of the beam by the electromagnet in the extracted beam transportation system are both utilized parallely, the beam is more positively stopped. Further, after the stopping operation is done by interrupting the beam extraction, it is possible to extract a beam remaining in the accelerator by applying again an irregular signal for extraction. FIG. 23 shows the case where the irregular signal is applied for extracting the beam. The same effect can be achieved by applying an a.c. signal of a constant frequency or plural frequencies.

Figure 12:
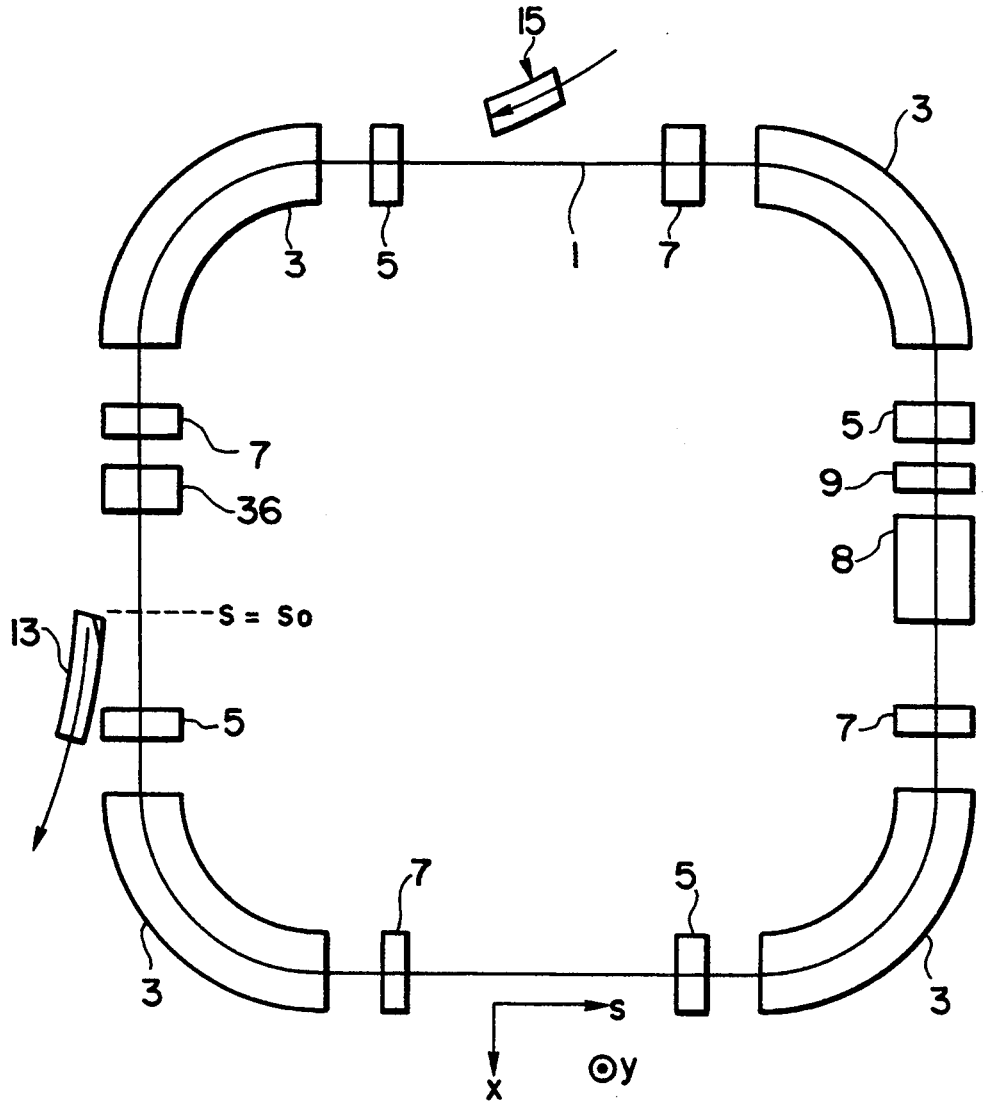
FIG. 12 is a view showing a driving method according to a sixth embodiment of the invention.
Figure 13:
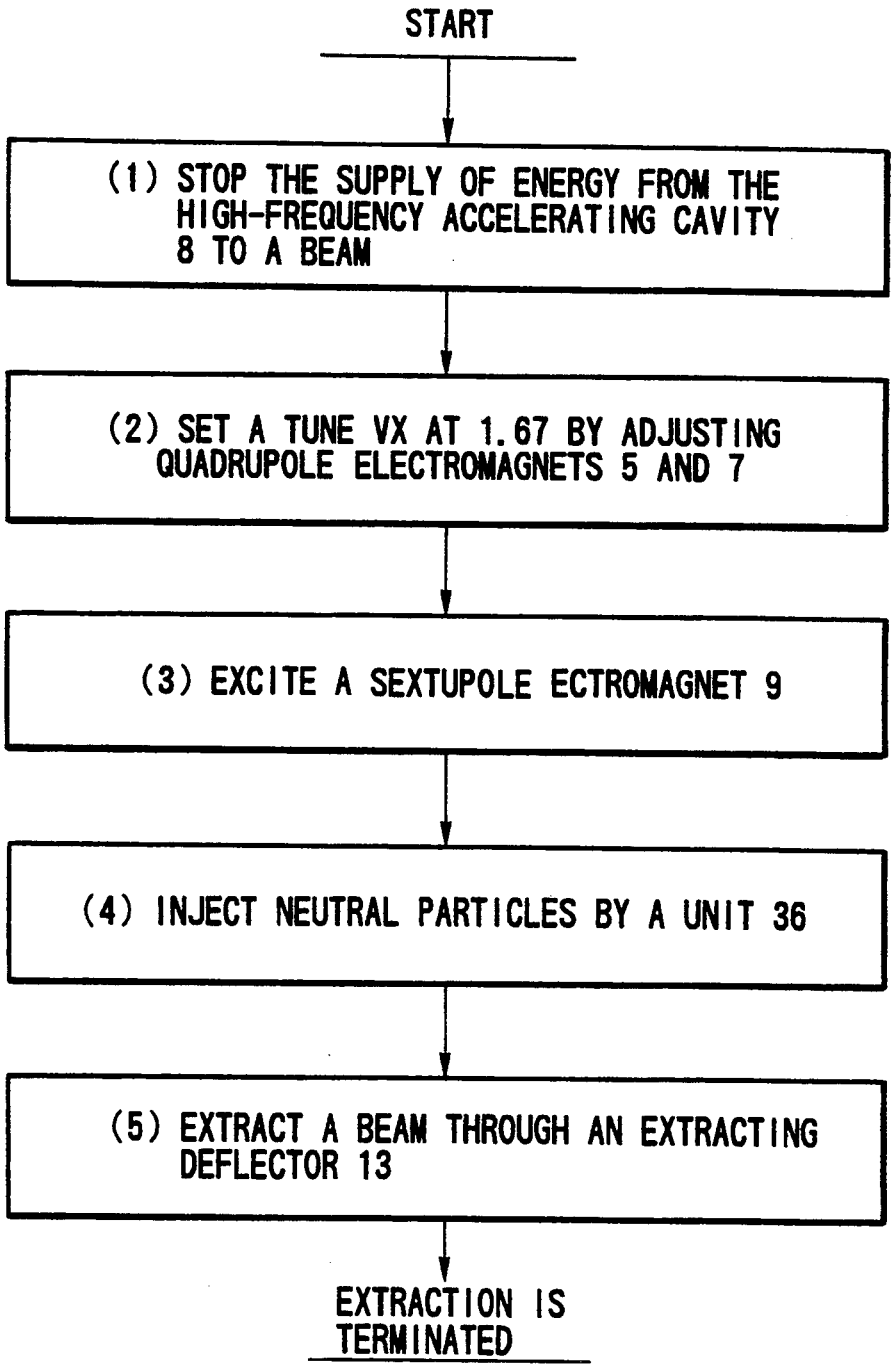
FIG. 13 is a flowchart showing a driving method executed in the sixth embodiment.

Next, the description will be directed to a sixth embodiment of the invention by referring to FIG. 12. In the sixth embodiment, by causing the neutral particles to collide with the circulating beam, the betatron oscillation amplitudes of the particles within the stability limit of resonance are increased. In the embodiment shown in FIG. 1, the high-frequency applying unit 14 is used for applying a time-variable electromagnetic field to a beam. This embodiment utilizes a neutral particle injecting unit 36 in place of the high-frequency applying unit 14. The driving method in the sixth embodiment is shown in FIG. 13. FIG. 13 is the same as FIG. 4 except for the step (4) in which the neutral particles are injected. The collision of the neutral particles with the beam causes the betatron oscillation amplitude of the circulating beam to gradually increase. Hence, it is possible to extract the beam under a condition of a constant beam position, a constant beam diameter and a constant turn separation, while keeping the stability limit of resonance constant. The extracting current can be adjusted by the amount of injected neutral particles.

Figure 14:
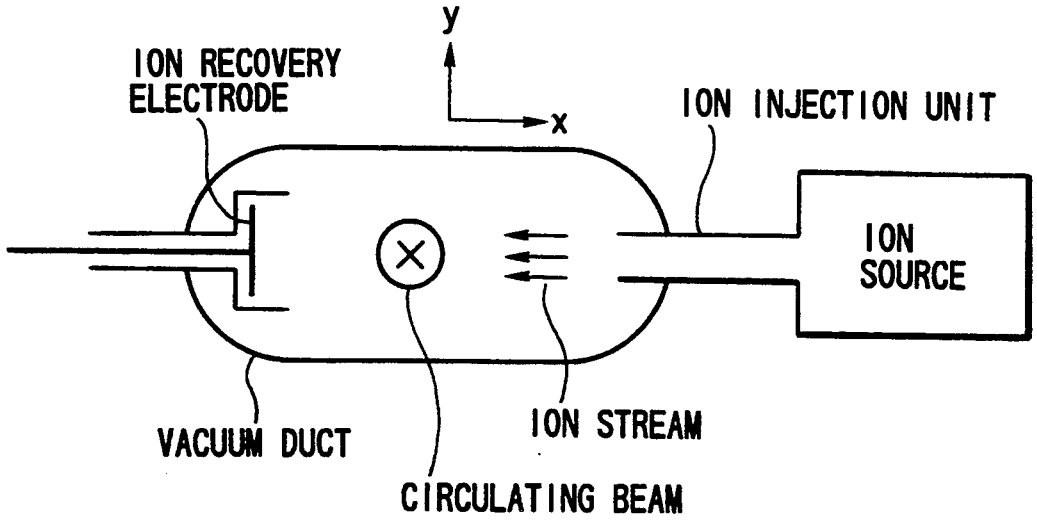
FIG. 14 is a view showing an ion-injection unit according to a seventh embodiment of the invention.

Next, the description will be directed to a seventh embodiment of the invention. In this embodiment, the collision of a different charged-particle beam with the circulating beam is used for increasing the betatron oscillation amplitude of the particles within the stability limit of resonance. The sixth embodiment shown in FIG. 12 utilizes the neutral particle injecting unit 36. But, this embodiment utilizes an ion injection unit 36 whose cross-section is shown in FIG. 14. The particles from an ion source are horizontally injected into an area of the circulating beam. The ion injection is carried out in place of the injection of the neural particles in the driving method shown in FIG. 13. As to the extraction of a beam, this embodiment provides the same effects as the driving method shown in FIG. 13.

In addition, the same effects can be realized by providing, a thin film at the area where gas or ions are injected and causing the charged-particle beam to collide with the thin film.

Next, the description will be directed to other embodiments of the invention which use means of (4), (5) and (6) described in "Summary of the Invention".

Figure 19:
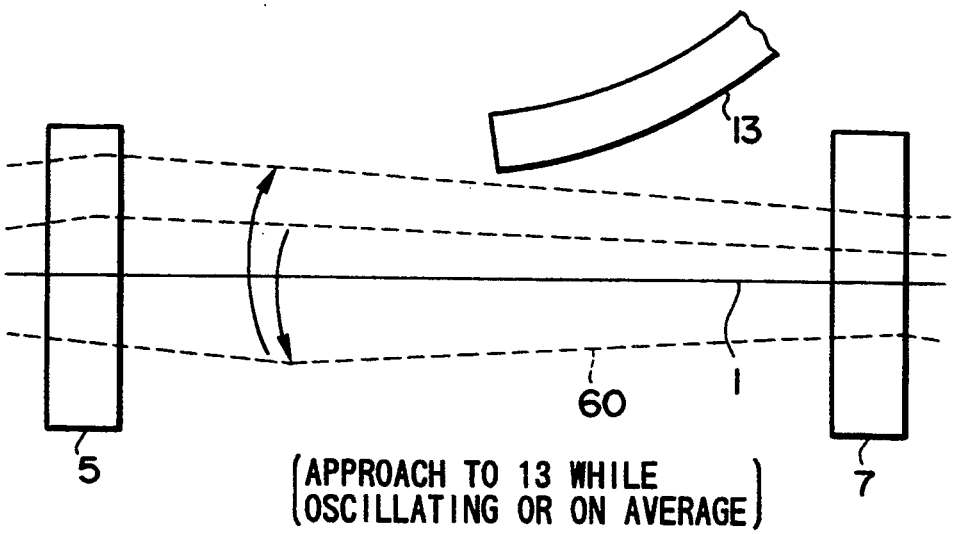
FIG. 19 is a view for explaining a function of the invention.

FIG. 19 shows the magnet arrangement and a beam center orbit around a=so, assuming that so indicates the location of the extracting deflector 13 in the s-direction. A solid line 1 indicates the designed orbit, that is, the orbit of the beam center stably circulating before the beam is extracted. Normally, the orbit of the beam center coincides with the center line of the vacuum duct. According to the invention, as shown in FIG. 19, the orbit of the beam center is caused to shift while oscillating or shift in one direction thereby causing the orbit of the beam center to approach in average to the extracting deflector and then the beam is extracted in a form of bunches. As a result, it is possible to efficiently extract the beam having a large diameter. Thus, this invention provides a circular accelerator having high utilization efficiency or large extracting current and a method for extracting a charged-particle beam in the circular accelerator.

Next, the description will be directed to means for moving the orbit 60 of the beam center. For moving the beam center, the following three methods may be taken as described in "Summary of the Invention".

For an electromagnetic field of means (4), the electric field is applied in parallel to the extracting plane and the magnetic field is applied vertically to the extracting plane for changing the orbit gradient of the beam. The beam circulates along the designed orbit 1, as shown in FIG. 1, while betatron-oscillating. As mentioned above, the number of oscillations per one circulation is referred to as a tune. The frequency of the electromagnetic field of (4) is selected at a value at which the whole beam, that is, the beam center is synchronized with the betatron oscillation. That is, the selected frequency is almost equal to a value $nfr \pm fr\nu s$ where n is an integer, $\nu s$ is a fraction of the tune and fr is a circulating frequency fr. If the shift of the used frequency from $nfr \pm fr\nu s$ is within $\pm 10\%$ of the frequency fo, the externally applied electromagnetic field is synchronized with the betatron oscillation. This results in oscillating the whole beam, that is, the center of the beam, thereby increasing the oscillation amplitude of the beam as the beam in each circulation so that the whole beam approaches the extracting deflector and finally the beam is entered into the deflector from its end and then extracted.

The electromagnetic field of the means (5) is applied at the position where a dispersion function is not zero and in a manner to direct the electric field in the direction of the beam circulation. With the dispersion function $\eta$, the horizontal distance x of the center of the beam, of which the momentum is deviated from the designed value by $\Delta p/p$, from the center of the duct is given by the following expression:

$$x = \eta \cdot \Delta p/p$$

wherein the dispersion function $\eta$ is a parameter of the accelerator defined by the excitations of the bending electromagnet 3 and the quadrupole electromagnets 5 and 7.

Therefore, in order to sequentially extract the beam from its end, the energy of the beam is changed thereby changing the momentum of the beam so as to cause the center of the beam approach the extracting deflector.

The magnetic field of means (6) is applied in the vertical direction (y direction) when the extracting plane is horizontal and is applied in the horizontal direction (x direction) when the extracting plane is vertical. This is a method of moving the center of the beam by changing the orbit gradient of the beam by the effect of the magnetic field in which the magnetic field of the electromagnet is changed so as to cause the center of the beam, that is, the whole beam to approach the extracting deflector each circulation of the beam so that the beam is finally entered into the deflector from its end and then extracted.

Figure 24:
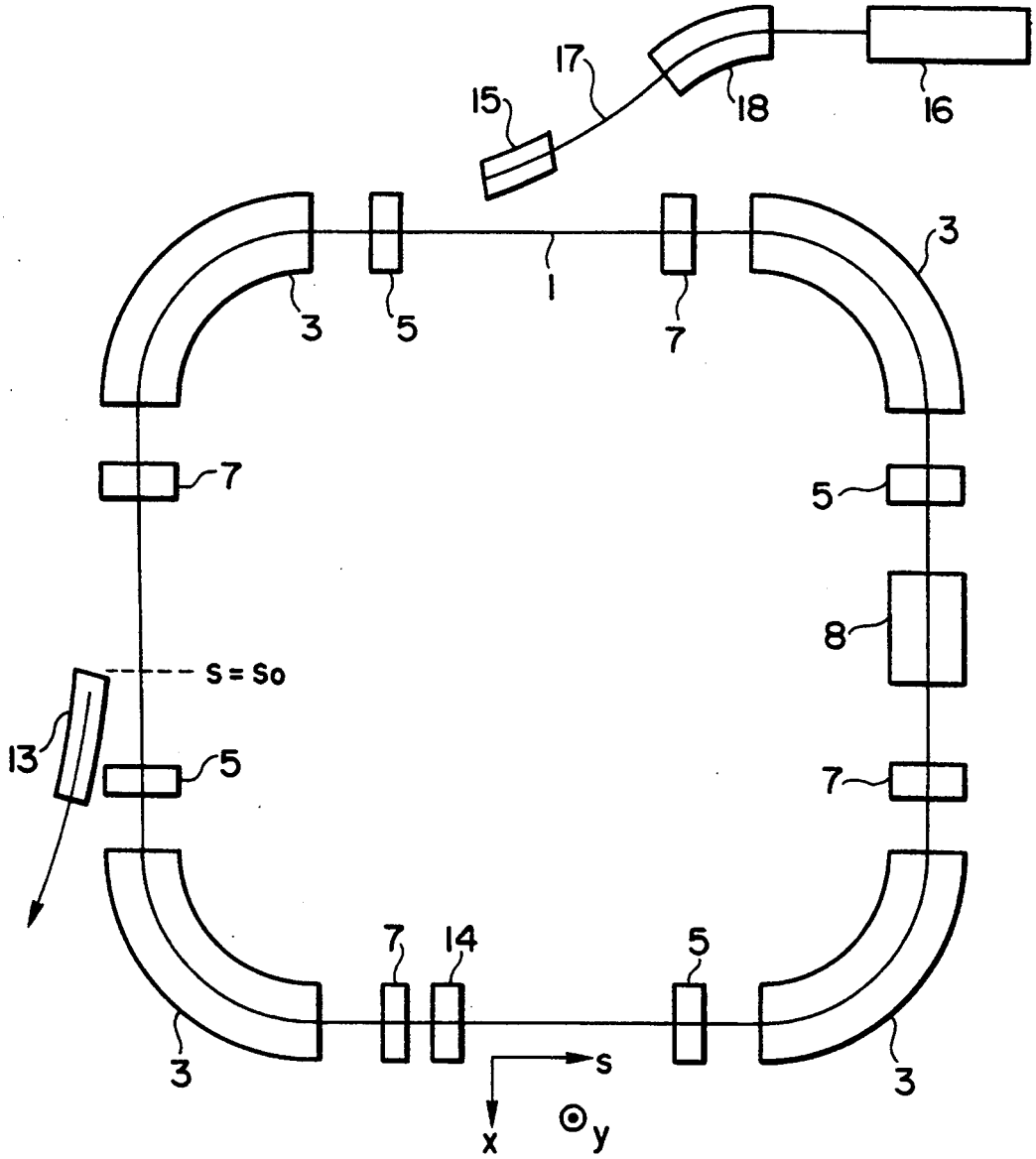
FIG. 24 is a view showing a circular accelerator according to an eighth embodiment of the invention.

FIG. 24 shows a circular accelerator according to the eight embodiment of the invention. In this circular accelerator protons having about 20 MeV energy are injected, accelerated up to 100 MeV, and then extracted. A beam 17 supplied from a pre-stage accelerator 16 is injected into the circular accelerator through a beam transportation system 18 and an injection unit 15. As shown, the circular accelerator is arranged to have a high-frequency accelerating cavity 8 for feeding energy to the injected beam 17, a bending electromagnet 3 for bending the beam orbit, quadrupole electromagnets 5, 7 for controlling a betatron oscillation of the beam, an extracting deflector 13 for extracting particles through the extracted beam transportation system, and a high-frequency applying unit 14 for causing the center position of the beam to oscillate. The unit 14 and the extracting deflector 13 are used only in the step of extracting the beam after accelerated up to a target energy.

The orbit of the beam injected from the injecting unit 15 is curved by the bending electromagnet 3 while the beam is circulating. The four-pole electromagnet serves to change the orbit gradient of the beam by a force proportional to the shift of the actual orbit from the designed orbit 1. The four-pole electromagnet 5 serves to change the orbit gradient in a direction of horizontally converging the beam. The four-pole electromagnet 7 serves to change the orbit gradient in a direction of horizontally diverging the beam. With respect to the vertical direction, conversely, the four-pole electromagnet 5 functions to diverge the beam and the four-pole electromagnet 7 functions to converge the beam. The actions of these four-pole electromagnets cause the beam to betatron-oscillate while it circulates along the designed orbit 1. The number of betatron oscillations is controlled by the intensity of excitation of each of the converging four-pole electromagnet 5 and the diverging four-pole electromagnet. The number of betatron oscillations per one circulation is referred to as a tune. In this embodiment, the four-pole electromagnets 5 and 7 are adjusted so that the horizontal tune $\nu x$ is 1.75 and the vertical tune $\nu x$ is 1.25. Under this condition, the beam stably circulates in the accelerator, and receives energy from the high-frequency cavity 8. The frequency f applied to the cavity is integer-times (n-times) of a frequency at which the beam is circulating. The beam circulates in a form of n blocks (bunches) queued in the direction of circulation, that is, the s direction in synchronism with the frequency f.

Figure 25:
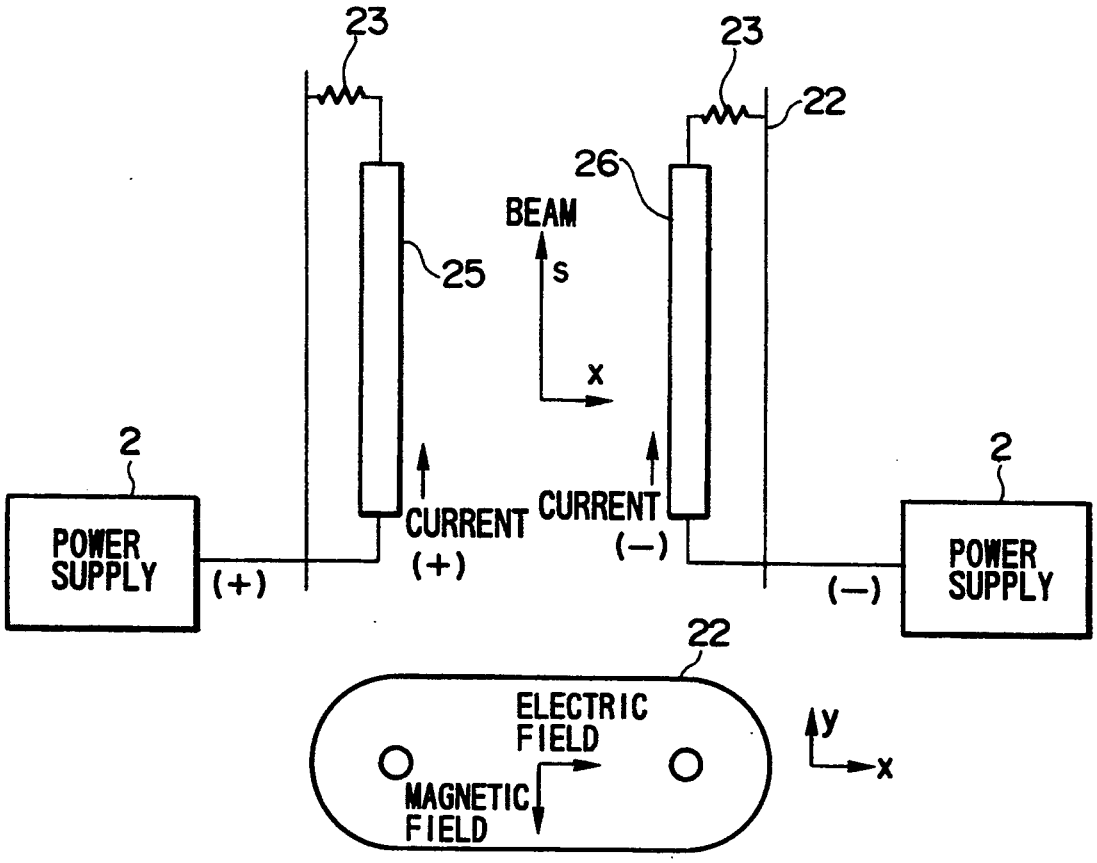
FIG. 25 is a view showing a high frequency applying unit for extracting a beam in the eighth embodiment.

Then, the high-frequency applying unit 14 shown in FIG. 24 operates to apply a high-frequency electromagnetic field to the beam. FIG. 25 shows the high-frequency applying unit 14 and its power supply 2. The high-frequency applying unit 14 includes two electrodes 25, 26 to which the power supply 2 applies a high-frequency voltage. The voltage and current applied to the electrode 25 have a polarity opposite to that of the voltage and current applied to the electrode 26 so that the magnetic field and the electric field are applied to the beam in respective directions as shown in FIG. 25. A load resistance 23 shown in FIG. 25 is provided for preventing the applied current being reflected at the electrode end back to the power supply. The high frequency f is set to a value fe obtained by multiplying the circulating frequency fr of the beam by a fraction 0.75 of the horizontal tune 1.75. Sum of the frequency fe and a frequency which is integer times of the frequency fr can provide the same effect. The oscillation of the electromagnetic field is synchronized with the oscillation of the beam circulating in the accelerator. By the effect of the electromagnetic field, an absolute value of the orbit gradient is increased each time the beam makes one circulation along the orbit. The oscillation amplitude of the beam center is increased each time the beam passes through the high-frequency applying unit 14. As a result, the whole beam approaches the extracting deflector while oscillating. By the continued application of the high-frequency voltage to the electrodes 25 and 26, the oscillation amplitude of the beam center is increased, so that the beam passes over the electrodes of the extracting deflector 13 from its end and enters into the beam transportation system. In this embodiment, only one electrode pair is provided for applying a high frequency to the beam. More than one electrode pairs may be provided at a plurality of locations in the accelerator.

Figure 26:
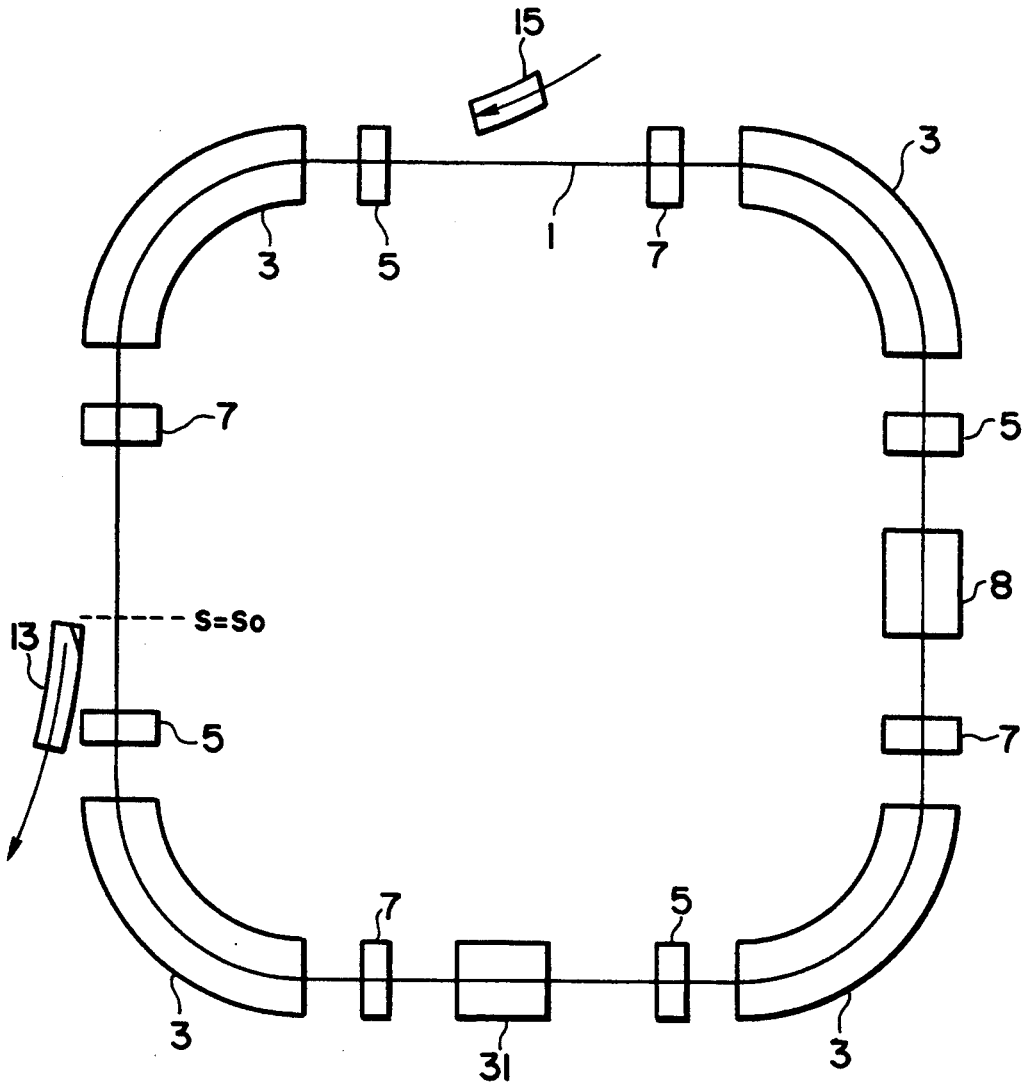
FIG. 26 is a view showing a circular accelerator according to a ninth embodiment of the invention.
Figure 27:
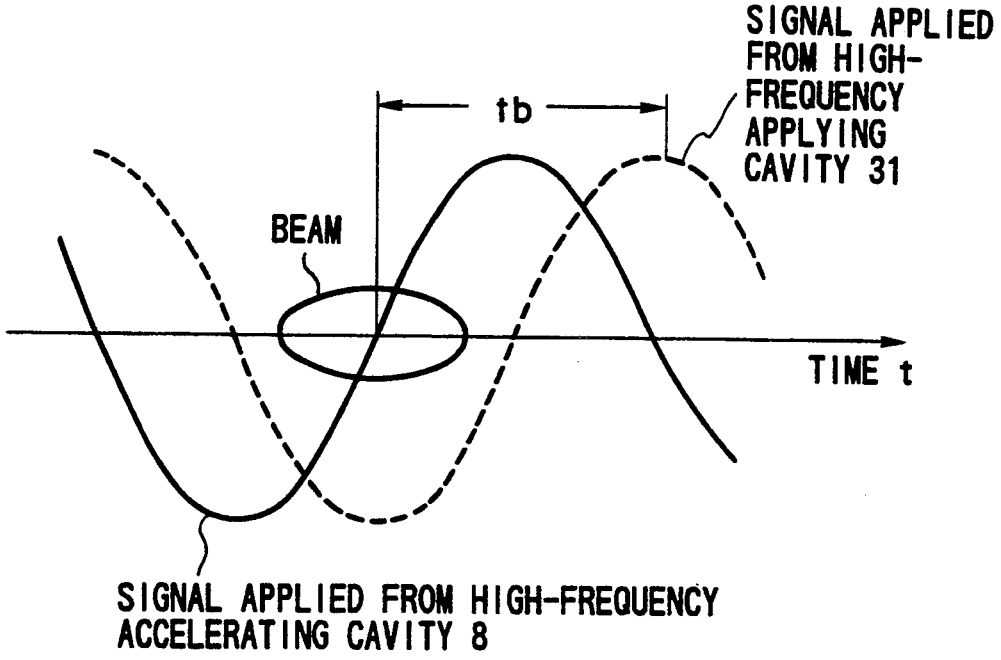
FIG. 27 is a graph showing a phase relationship between the high frequency and the beam in the ninth embodiment.

Next, the description will be directed to a ninth embodiment of the invention. The ninth embodiment is arranged to apply to a beam a high frequency providing an electric-field in a direction of circulation of the beam. FIG. 26 shows an arrangement of the ninth embodiment. The high-frequency electric field is applied by a high-frequency applying cavity 31 provided at a place where the dispersion function is not zero. The ninth embodiment is the same as the eighth embodiment except that the high-frequency applying cavity 31 is provided in place of the high-frequency applying unit 14. The high-frequency applying cavity 31 has the same structure as the high-frequency accelerating cavity 8 for increasing the energy of the beam. The cavity 31, however, is used only for extracting the beam. A high frequency applied to each of the cavities 8 and 31 is the same as the circulating frequency fr of the beam. The frequency applied to the extracting high-frequency applying cavity 31 is shifted in phase from the frequency applied to the conventional high-frequency accelerating cavity 8 in a manner as mentioned next. The time variation of intensity of each high frequency and the relation between the beam position and the phase of each high-frequency are illustrated in FIG. 27. As shown, the beam is positioned near a phase angle where the high-frequency voltage applied to the high-frequency accelerating cavity 8 is changed from negative to positive at a time when the extraction is started. On the other hand, a high frequency applied to the high-frequency applying cavity 31 has a phase advanced from the high frequency applied to the high-frequency accelerating cavity 8 at the time when the extraction is started. The phase difference is set such that the intensity of the high-frequency electric field applied to the beam becomes maximum at the high-frequency applying cavity 31 by taking into consideration a time tb required for the beam to travel from the high frequency cavity 8 to the high-frequency applying cavity 31. This embodiment provides additionally the high-frequency applying cavity 31. The use of the conventional high-frequency accelerating cavity 8 only may be enough to achieve the same effect by rapidly shifting the high-frequency phase by 90° when the beam extraction is started.

Figure 28:
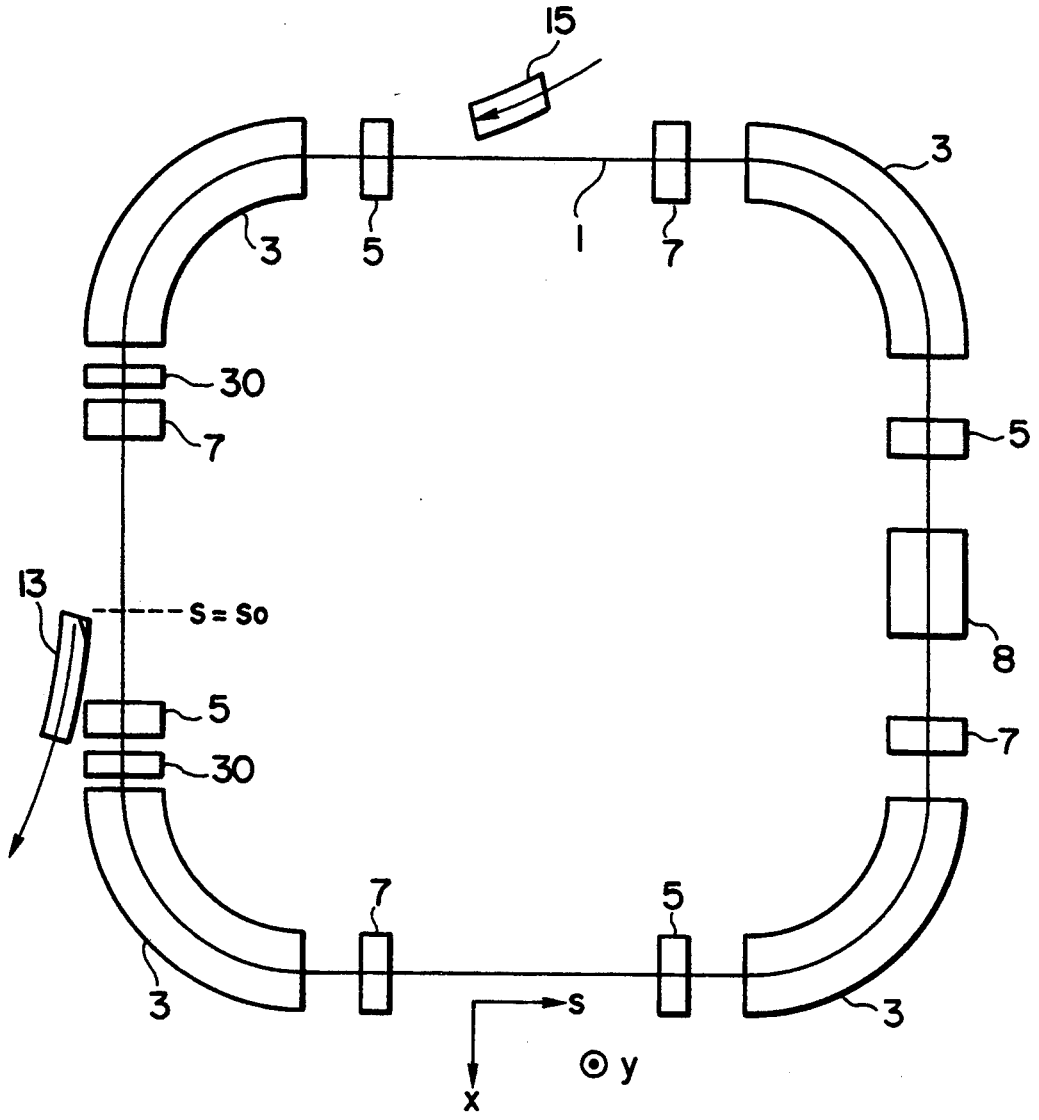
FIG. 28 is a view showing a circular accelerator according to a tenth embodiment of the invention.
Figure 29:
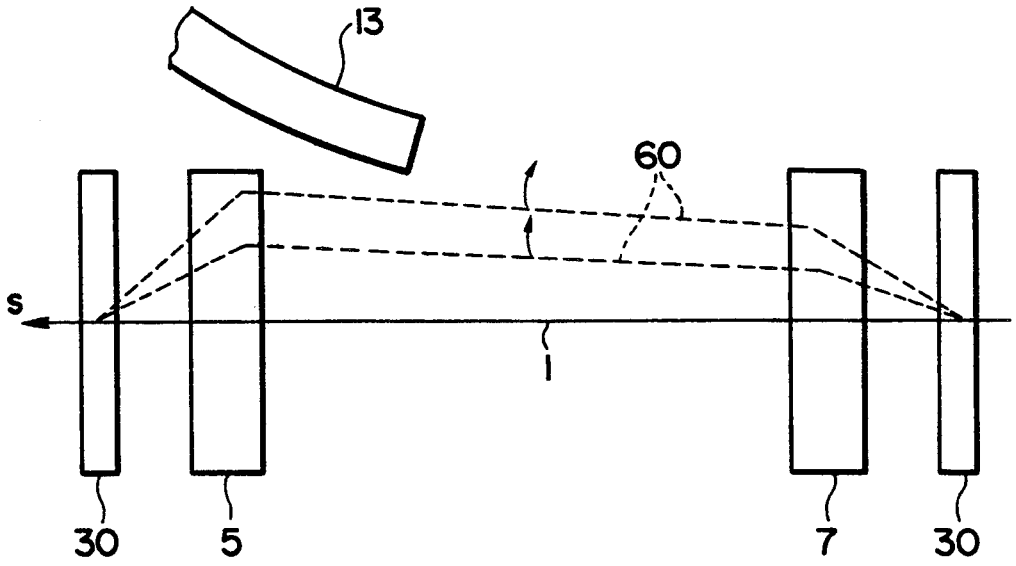
FIG. 29 is a view showing variation of a center of beam orbit in the tenth embodiment.

Next, the description will be directed to a tenth embodiment of the invention by referring to FIG. 28. As shown, a plurality of dipole electromagnets 30 are provided before and after the extracting deflector 13 so as to change the position of the beam center at the process of beam extraction and cause the whole beam to approach the extracting deflector 13. By properly adjusting the proportions in intensity of a plurality of, for example two, dipole electromagnets 30 as shown in FIG. 28, it is possible to shift the orbit of the beam center, only at an area disposed between the two electromagnets 30 provided before and after the extracting deflector 13, respectively, toward the extracting deflector, as shown in FIG. 29, while maintaining the orbit of the beam center at the center of the vacuum duct, i.e. the designed orbit at areas other than the first-mentioned area. By increasing the intensities of the magnetic fields by the electromagnets 30, while maintaining the proportions in intensity of the magnetic fields constant, the beam center approaches to the extracting deflector. By changing the excitations of the electromagnets so that the beam center is sufficiently changed each time the beam makes one circulation, the beam is entered into the extracting deflector 13 continuously from its end and extracted outside. This embodiment uses the dipole electromagnets 30. However, this embodiment may be used in combination with the method of using a high frequency mentioned with respect to the eighth and the ninth embodiments for obtaining the same effect.

Figure 30:
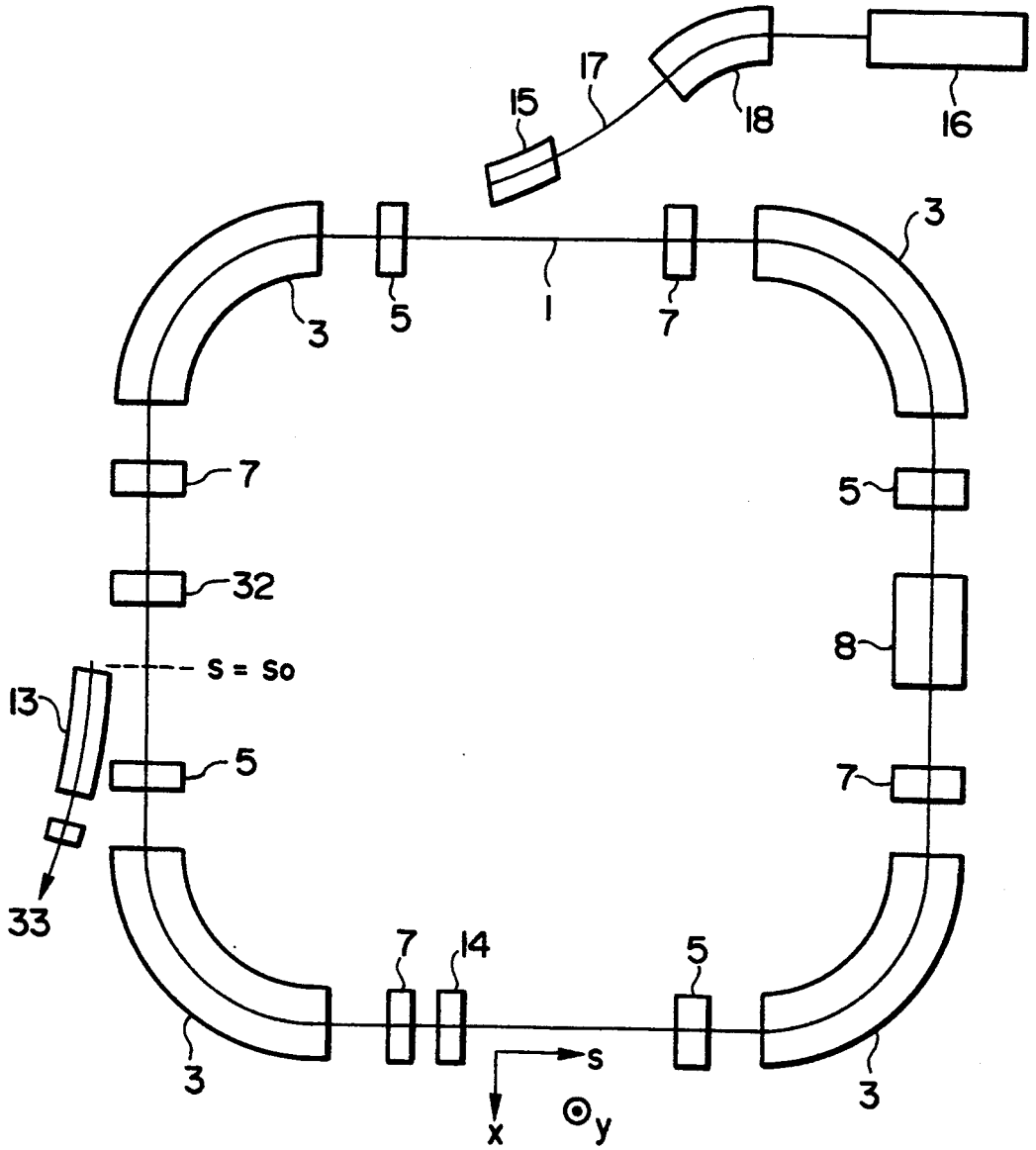
FIG. 30 is a view showing a circular accelerator according to an eleventh embodiment of the invention.

Next, the description will be directed to an eleventh embodiment of the invention. This embodiment is relating to a method of adjusting the position of the beam as extracted. The arrangement of the eleventh embodiment is shown in FIG. 30. In addition to the components of the eighth embodiment shown in FIG. 24, the eleventh embodiment further provides a beam position measuring unit 32 and a beam current measuring unit 33. The former unit 31 is located in the front of the extracting deflector 13 and operates to sense the position of the beam center. The latter unit 33 is located in the rear of the extracting deflector 13. By using the beam position measuring unit 32, the time-variation of the beam center position is obtained. This time-variation is used for determining the intensity of the high frequency applied from the high frequency applying unit 14 and the pattern of time-variation thereof required for obtaining the desired time-variation of the beam center position. Further, the beam current measuring unit 33 is provided in the rear of the extracting deflector 13 to detect the beam current. The voltage and frequency of the high frequency required for obtaining the maximum or necessary current are determined based on the detected beam current. The beam measurement and the control and adjustment based on the result of measurement according to this embodiment can be applied to the ninth and tenth embodiments.

Figure 15:
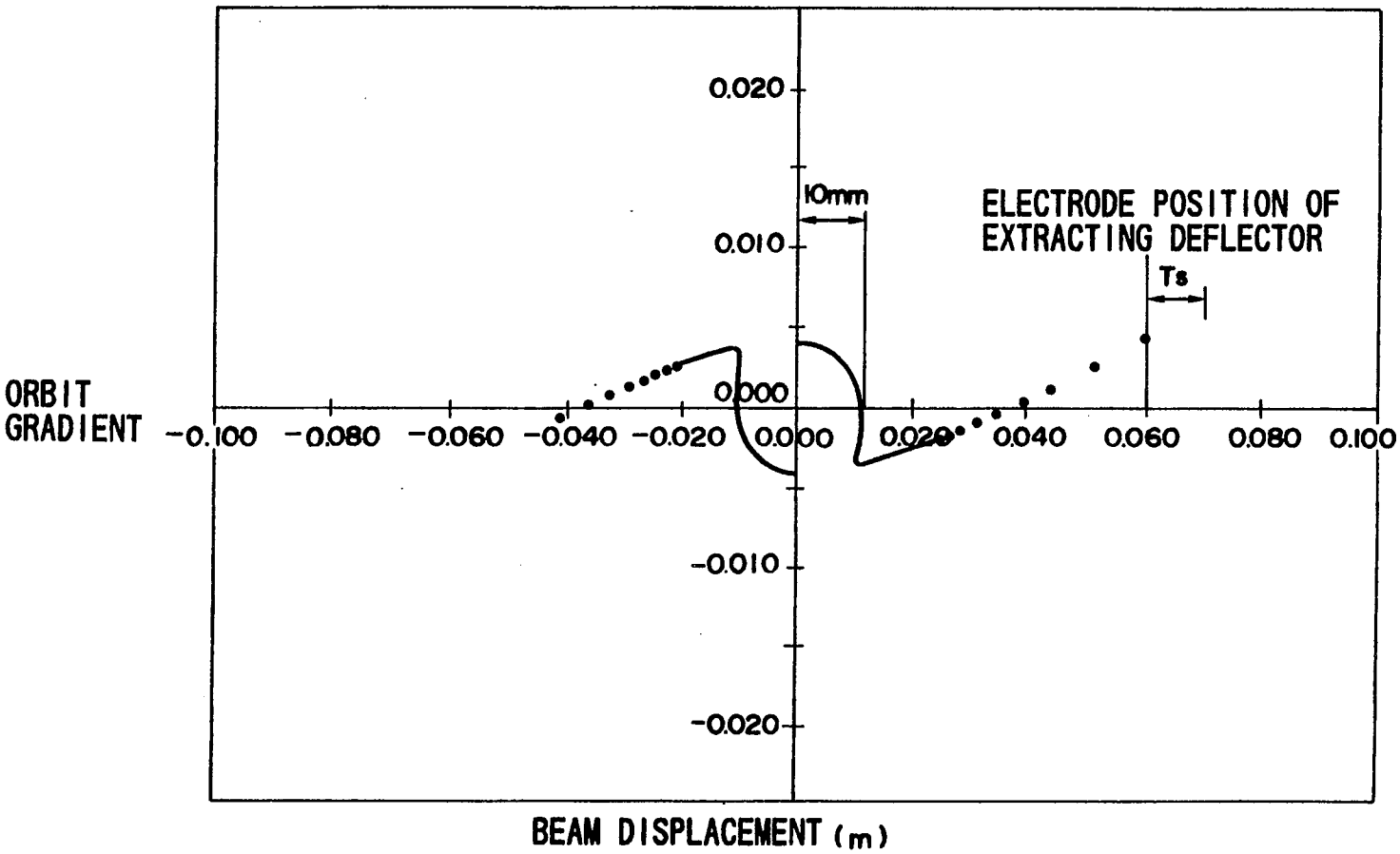
FIG. 15 is a diagram showing a phase space appeared when the resonance is caused on protons having a 10 mm amplitude of betatron oscillations before generation of the resonance in the conventional driving method.
Figure 16:
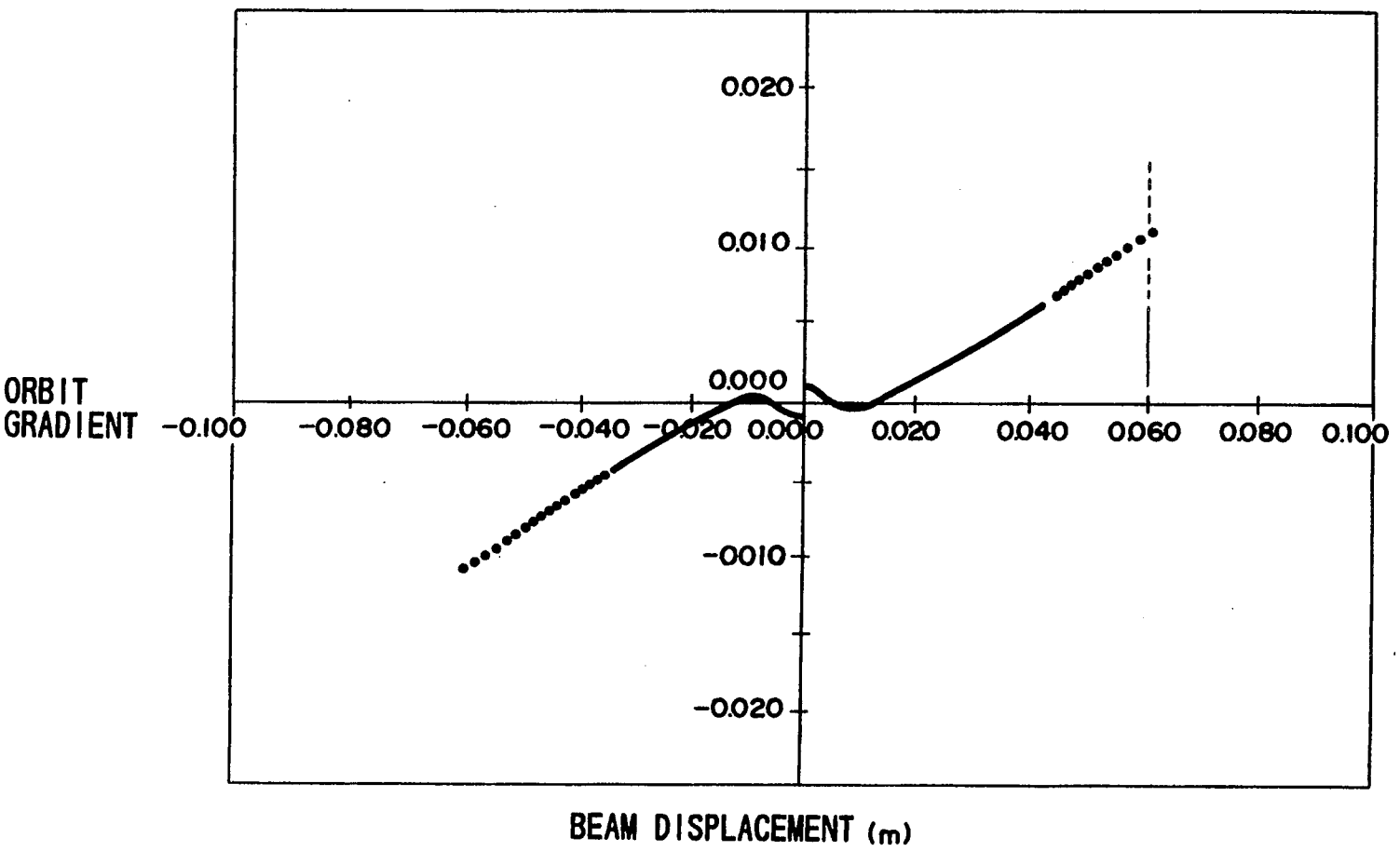
FIG. 16 is a diagram showing a phase space appeared when the resonance is caused on protons having a 3 mm amplitude of betatron oscillation before generation of the resonance in the conventional driving method.
Figure 17:
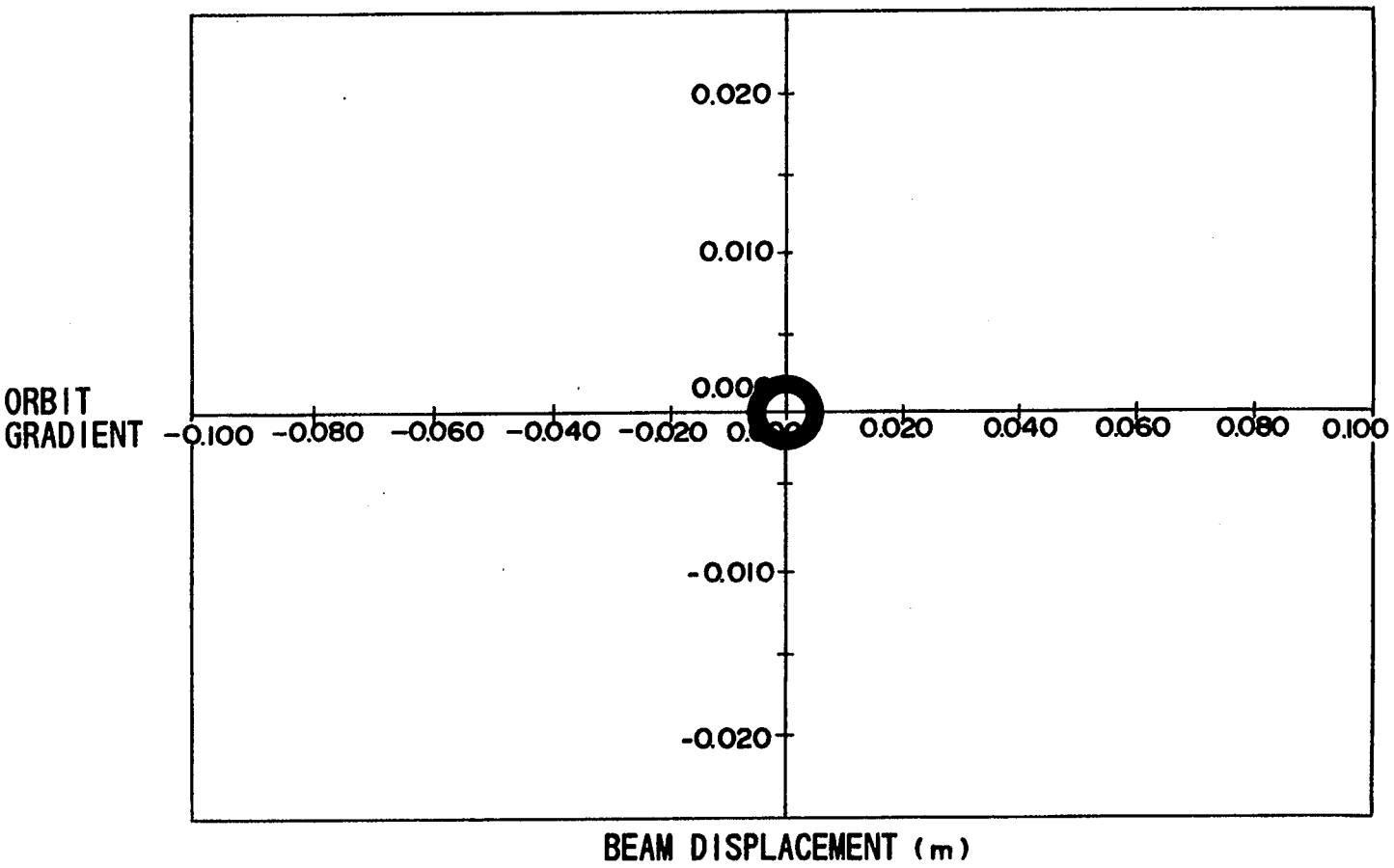
FIG. 17 is a diagram showing a phase space appeared when the resonance is caused on protons having a 3 mm amplitude of betatron oscillation before generation of the resonance in the driving method of the invention.
Figure 18:
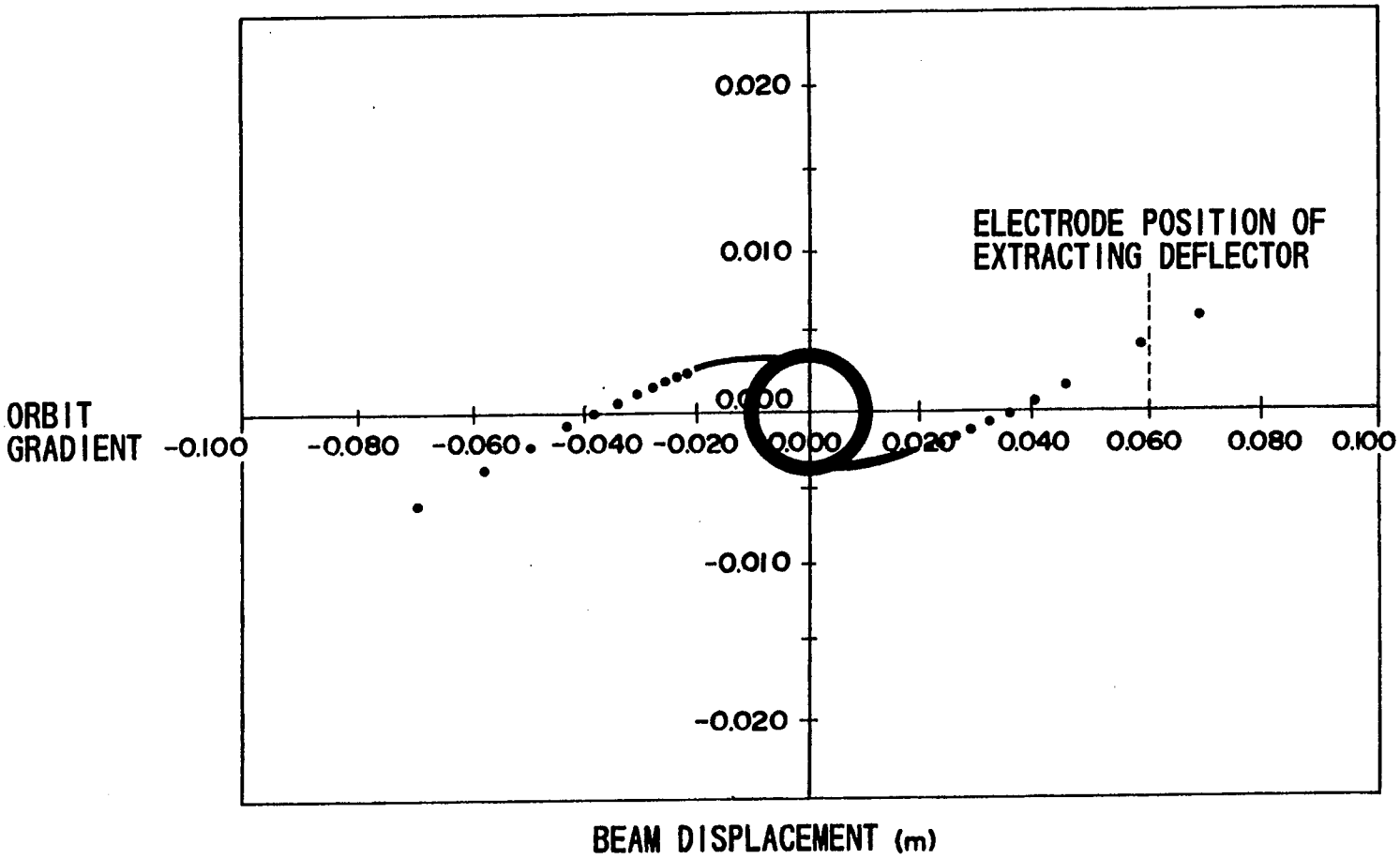
FIG. 18 is a diagram showing a phase space appeared when protons exceeding the stability limit (about 10 mm) are extracted upon further progress of the state shown in FIG. 17.

The technical effects of the invention will be explained by simulation hereinafter. The conditions for simulation are as follows: Protons are used for charged particles. The final energy of the beam as circulated is 300 Mev. The used resonance is a secondary resonance as mentioned in the third embodiment. The electrodes of the extracting deflector are located with a horizontal interval of 60 mm. FIGS. 15 and 16 show the phase spaces appeared when the used protons, whose amplitudes of betatron oscillations before generation of the resonance are 10 mm and 3 mm, respectively, are resonated by adjusting the shift of tune from $\frac{1}{2}$ to 0.01 and then the shift is changed from 0.01 to 0.001. The stability limit of the secondary resonance presents a form of ellipsoid different from that in the third embodiment. FIGS. 17 and 18 show the driving methods of the invention. FIG. 17 shows phase space plots appeared when the used protons have an amplitude of betatron oscillation of 3 mm before generating resonance, the resonance is caused by setting the shift of tune shift from $\frac{1}{2}$ to be 0.01 and the amplitude of betatron oscillation of the beam is irregularly and gradually expanded by the high-frequency applying unit 14. FIG. 18 shows phase space plots appeared when the state of FIG. 17 is further progressed and the protons exceeding the stability limit (about 10 mm) are extracted. In the conventional driving methods, the turn separation Ts is about 10 mm and 1 mm when the amplitude of betatron oscillation is 10 mm and 3 mm, respectively, before generating resonance. In the prior arts, therefore, the protons whose amplitude of betatron oscillation is 3 mm collide with the electrodes so that it is difficult to extrace the protons. When the shift of tune from $\frac{1}{2}$ is adjusted from 0.01 to 0.001, the extracting gradient is changed by 7 mrad. On the other hand, in the present invention, even if the amplitude of betatron oscillation is 3 mm before generating resonance, the amplitude of betatron oscillation is gradually increased and when it reaches 10 mm, the resonance generates and the beam is extracted at a turn separation Ts of 10 mm in the same manner as in the case of FIG. 16. Further, the difference of the orbit gradient at the position of the extraction deflector between the case where the initial amplitude of betatron oscillation is less than 3 mm and the case where the initial amplitude is 10 mm is less than 0.01 mrad and the emittance of the extracted beam is 1 $\pi$ mm mrad. It is possible, therefore, to extract a beam having an amplitude of betatron oscillation of less than 10 mm as well as the beam having an amplitude of betatron oscillation of 10 mm. In the present invention, it is possible to maintain the tune and the turn separation constant so that the gradient of the extracted beam, the position of extraction and the beam size are maintained constant. Further, since the distribution of the beam orbit traces becomes wider as the amplitude of betatron oscillation becomes smaller, the present invention is capable of achieving 90% or more of extraction efficiency, while the conventional methods can not achieve 50% or more of extraction efficiency.

Figure 32:
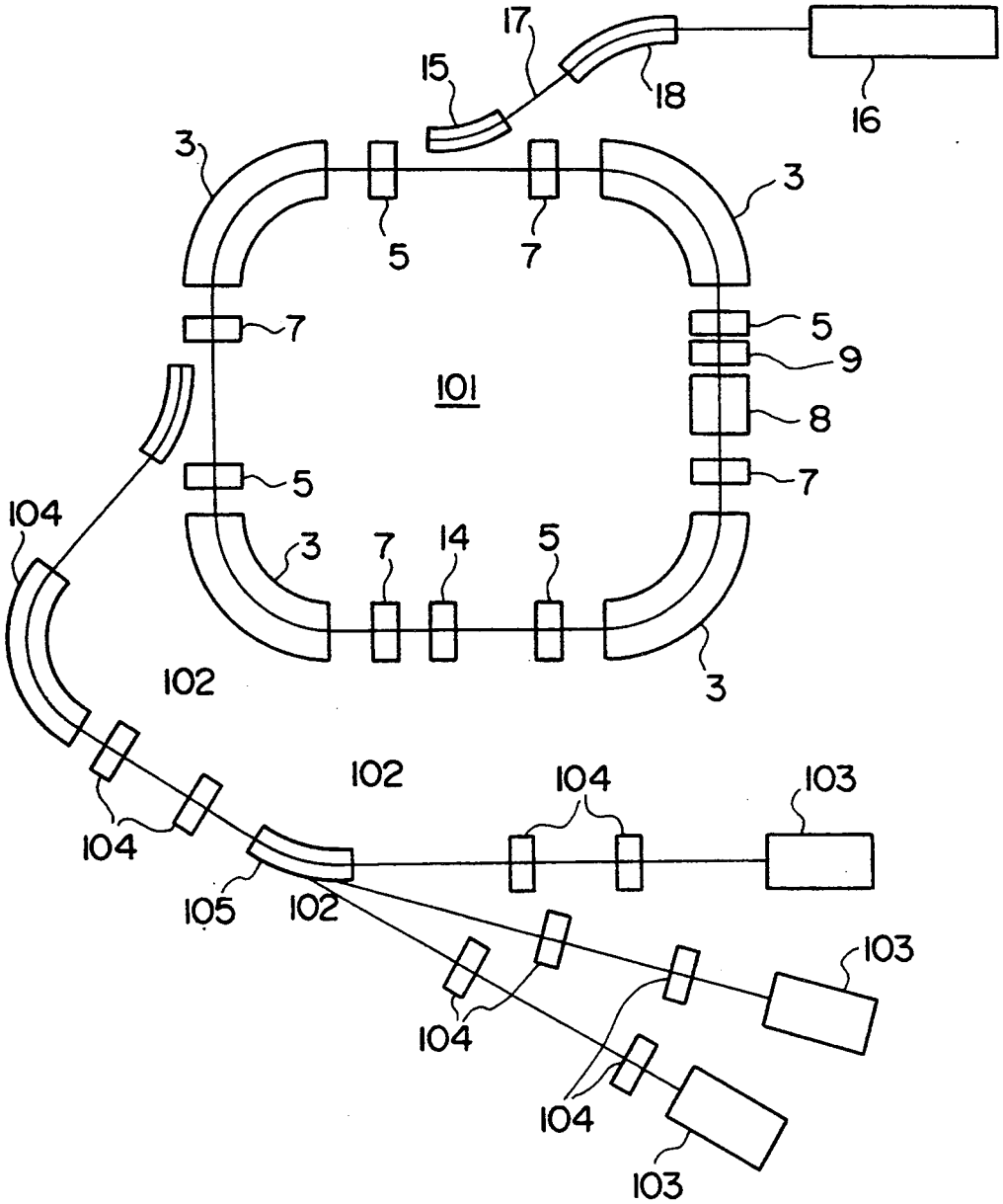
FIG. 32 shows a construction of an accelerator for medical use according to the invention.

Finally, an embodiment of an accelerator for medical use according to the present invention will be explained with reference to FIG. 32. In this embodiment, the beam supplied from a pre-accelerator 16 is injected by an injector 15 into a circular accelerator 101. The construction of the accelerator 101 and the method of extracting the beam are the same as those in the embodiment of FIG. 1. That is, the beam is accelerated to a desired energy level in 0.5 sec after injected from the pre-accelerator 16 and extracted in a form of pulse-like beam for one second. In the subsequent 0.5 seconds, the excitation of the electromagnets is reduced to wait for injection and extraction of the next beam. In this manner, the injection, acceleration and extraction of a beam are repeated every two seconds. In extraction, the stability limit for resonance is maintained constant and the amplitude of betatron oscillation is increased by the extracting high-frequency applying unit 14 to generate resonance of the beam. Since the stability limit for resonance is constant, the orbit gradient at the extraction deflector and the turn separation are maintained constant so that it is possible to extract the beam at a constant efficiency of more than 90%. The beam extracted from the extraction deflector 13 is transported through a transport line 102 to a plurality of treatment rooms 103. On the transport line 102, electromagnets 104 are provided for adjusting the beam size and the orbit gradient. The emittance of the transported beam is less than 1 $\pi$ mm mrad as mentioned with reference to FIGS. 15 and 18. The beam diameter is obtained as a twice of a square root of a product of a value of the emittance and a quantity called as the betatron function. The betatron function is dependent on the position on the transport line and adjustable at less than 20 m by adjusting the excitation of the transport electromagnets 104 so that the maximum beam size is about 10 mm. Therefore, the diameter of the vacuum duct provided to the transport line can be reduced less than 20 mm. The extracted beam is transported selectively to one of the treatment rooms by switching the transport line by a beam switching electromagnet 105. The switching of the transport line is effected in a short time of less than 1 sec corresponding to the time for extraction of one pulse of the beam. Thus, the beam is applied to a plurality of treatment rooms successively during one extraction of the beam. Of course, it is possible to apply the beam to only one treatment room during one extraction of the beam and to switch the beam transportation to another treatment room before the next extraction of the beam. The size and position of the beam as irradiated on a patient in the treatment room are adjusted by an electromagnet (not shown) for adjustment of the beam irradiation. By the method of beam extraction according to the present invention, the emittance of the extracted beam is maintained constant at less than 1 $\pi$ mm mrad so that the beam size and the variation of beam position as irradiated can be reduced less than 3 mm.

The present invention can provide a circular accelerator having a high extraction efficiency of the circulated charged-particle beam and a method and an apparatus for extracting a charged-particle beam.

The present invention can provide a circular accelerator having a large extracting current and a method and an apparatus for extracting a charged-particle beam.

The present invention can provide a circular accelerator which keeps the position of a beam extracted from a transportation system constant and a method and an apparatus for extracting a charged-particle beam.

The present invention can provide a circular accelerator which can control an output current and a method and an apparatus for extracting a charged-particle beam.

The present invention can provide a small circular accelerator.

What is claimed is:

1. A circular accelerator comprising:

an electromagnet for circulating a charged-particle beam;

means for extracting said charged-particle beam through an extracting deflector in a resolating state, said extracting means including;

means for resonating betatron oscillation of said beam, and means provided separately from said resonating means for increasing betatron oscillation amplitudes of said charged-particle beam.

2. A circular accelerator as claimed in claim 1, wherein said means for increasing said betatron oscillation amplitude is provided on a beam-circulating orbit and operates to generate a time-variable magnetic field.

3. A circular accelerator as claimed in claim 2, wherein the time-variable magnetic field contains a frequency component synchronized with the betatron oscillation.

4. A circular accelerator as claimed in claim 2, wherein a frequency of said time-variable electric field coincides with a frequency synchronized with the betatron oscillation with an error of ±5% or less.

5. A circular accelerator as claimed in claim 2, wherein said time-variable magnetic field changes randomly.

6. A circular accelerator as claimed in claim 5, wherein the time-variable magnetic field contains a frequency component synchronized with the betatron oscillation.

7. A circular accelerator as claimed in claim 1, wherein said means for increasing said betatron oscillation amplitude is provided on a beam-circulating orbit and operates to generate a time-variable electric field.

8. A circular accelerator as claimed in claim 7, wherein the time-variable electric field contains a frequency component synchronized with the betatron oscillation.

9. A circular accelerator as claimed in claim 7, wherein a frequency of said time-variable electric field coincides with a frequency synchronized with the betatron oscillation with an error of ±5% or less.

10. A circular accelerator as claimed in claim 7, wherein said means for generating said electric field is a cavity for accelerating said charged-particle beam.

11. A circular accelerator as claimed in claim 7, wherein the time-variable electric field changes randomly.

12. A circular accelerator as claimed in claim 11, wherein the time-variable electric field contains a frequency component synchronized with the betatron oscillation.

13. A medical system comprising the circular accelerator as claimed in claim 1, a beam transport line for transporting a beam of the extracted charged particles to an irradiation room, and means provided in said irradiation room for irradiating the transporting beam onto a given subject.

14. A circular accelerator comprising:

an electromagnet for circulating a charged-particle beam;

means for extracting said charged-particle beam through an extracting deflector in a resonating state, said extracting means including;

means for resonating betatron oscillation of said beam, and means for increasing betatron oscillation amplitudes of said charged-particle beam;

wherein said means for increasing said betatron oscillation amplitudes is means for causing particles different from said charged-particle beam to collide with said beam.

15. A circular accelerator comprising:

an electromagnet for circulating a charged-particle beam;

means for extracting said charged-particle beam through an extracting deflector in a resonating state, said extracting means including;

means for resonating betatron oscillation of said beam, and means for increasing betatron oscillation amplitudes of said charged-particle beam;

wherein the amplitude of betatron oscillation is increased when said beam is extracted.

16. A circular accelerator comprising:

an electromagnet for circulating a charged-particle beam;

means for extracting said beam through an extracting deflector in a resonating state, said extracting means including;

means for resonating betatron oscillations of said beam; and means provided separately from said resonating means for increasing betatron oscillation amplitudes of said charged-particles beam while substantially keeping its tune constant.

17. A circular accelerator comprising:

an electromagnet for circulating a charged-particle beam;

means for extracting said beam through an extracting deflector in the resonating state, said extracting means including;

means for resonating betatron oscillations of said beam, and means for increasing betatron oscillation amplitudes of the charged-particle beam which is not resonated by said resonating means.

18. A circular accelerator comprising:

an electromagnet for circulating a charged-particle beam; and means for extracting the charged-particle beam through an extracting deflector, wherein the extracted beam is 50% or more of the circulated beam.

19. A method of extracting a charged-particle beam in a circular accelerator comprising the steps of:

circulating a charged-particle beam;

resonating betatron oscillations of said charged-particle beam;

increasing amplitudes of said betatron oscillations of said charged-particle beam which are within a stability limit of resonance; and extracting said charged-particle beam through an extracting deflector.

20. A method of extracting a charged-particle beam in a circular accelerator comprising the steps of:

circulating a charged-particle beam;

resonating betatron oscillation of said charged-particle beam;

increasing amplitudes of said betatron oscillations of said charged-particle beam; and extracting said charged-particle beam through an extracting deflector;

wherein said resonating step includes a substep of maintaining an extracting angle of said beam as extracted from said extracting deflector substantially constant.

21. A method of extracting a charged-particle beam in a circular accelerator comprising the steps of:

circulating a charged-particle beam;

resonating betatron oscillations of at least a part of charged-particles of said charged-particle beam;

increasing an amplitude of said betatron oscillations of a remaining part of the charged particles of said charged-particle beam which are not resonated in said resonating step; and extracting said part and said remaining part of the charged-particles of said charged-particle beam through an extracting deflector.

22. A method of extracting a charged-particle beam in a circular accelerator comprising the steps of:

circulating a charged-particle beam;

resonating betatron oscillations of at least a part of charged-particles of said charged-particle beam, which exceed a stability limit of resonance;

increasing amplitudes of said betatron oscillations of a remaining part of the charged particles of said charged-particle beam which are within said stability limit of resonance thereby causing said remaining part of charged-particles to exceed said stability limit of resonance; and extracting said part of said remaining part of the charged-particles of said charged-particle beam through an extracting deflector.

23. A method as claimed in claim 22, wherein the step of increasing an amplitude of the betatron oscillation of said beam is achieved by resonance different from the resonance of said beam just before extraction thereof.

24. A method of extracting a charged-particle beam in a circular accelerator comprising the steps of:

circulating a charged-particle beam;

resonating betatron oscillations of said charged-particle beam, and adjusting a number of betatron oscillations of said charged-particle beam per one circulation thereof substantially equal to an integer $+p/q$, thereby increasing an amplitude of the betatron oscillations of particles within a stability limit of resonance; and extracting said charged-particle beam through an extracting deflector.

25. A method as claimed in claim 24, wherein at least one of an electric field and a magnetic field is applied to said beam for increasing the amplitude of said betatron oscillation.

26. A method as claimed in claim 25, wherein at least one of an electric field and a magnetic field containing a frequency component synchronized with the betatron oscillation is applied to said beam for increasing the amplitude of said betatron oscillation.

27. A method as claimed in claim 25, further comprising the step of controlling the extraction of the beam by changing a rate in increasing of the amplitude of the betatron oscillation within the stability limit of resonance.

28. A method as claimed in claim 25, further comprising the step of controlling the extraction of the beam by adjusting an intensity of at least one of an electric field and a magnetic field to be applied for increasing the amplitude of said betatron oscillation.

29. A method as claimed in claim 25, further comprising the step of controlling the extraction of the beam by adjusting the stability limit of the resonance of the betatron oscillation.

30. A method as claimed in claim 28, further comprising the step of adjusting at least one of an electric field and a magnetic field to be applied for increasing the amplitude of said betatron oscillation larger in a later stage of the excitation than that in its initial stage.

31. A method as claimed in claim 28, further comprising the step of starting extraction of the beam by applying at least one of an electric field and a magnetic field to said beam for increasing the amplitude of said betatron oscillation and stopping the extraction of the beam by stopping the application of said at least one of the electric field and the magnetic field.

32. A method as claimed in claim 28, further comprising the step of stopping the extraction of the beam in emergency by stopping said at least one of the electric field and the magnetic field for increasing the amplitude of said betatron oscillation.

33. A method as claimed in claim 25, wherein at least one of an electric field and a magnetic field randomly changing its strength is applied to said beam for increasing the amplitude of said betatron oscillation.

34. A method as claimed in claim 33, further comprising the step of controlling the extraction of the beam by adjusting the stability limit of the resonance of the betatron oscillation.

35. A method as claimed in claim 33, wherein at least one of an electric field and a magnetic field containing a frequency component synchronized with the betatron oscillation is applied to said beam for increasing the amplitude of said betatron oscillation.

36. An apparatus for extracting a charged-particle beam in a circular accelerator comprising:

a deflector for extracting said beam; and means for changing an orbit gradient of said beam a plurality of times in an extracting process.

37. A circular accelerator comprising:

an electromagnet for circulating a charged-particle beam;

an extracting unit for extracting said beam through a deflector; and said extracting unit having means for moving a center position of said beam as extracted by using at least one of a high frequency electric field and a high frequency magnetic field.

38. A circular accelerator as claimed in claim 37, wherein said at least one of the electric field and the magnetic field is changed at a frequency synchronized with betatron oscillation of said beam.

39. A circular accelerator as claimed in claim 37, wherein an orbit gradient on extracting plane of said beam is changed by said at least one of the electric field and the magnetic field.

40. A circular accelerator as claimed in claim 37, wherein energy of said beam is changed by the high frequency electric field.

41. A circular accelerator as claimed in claim 40, wherein the high frequency electric field is applied through a high-frequency accelerating cavity.

42. A circular accelerator as claimed in claim 37, wherein the high frequency electric field is applied through a high-frequency accelerating cavity.

43. A circular accelerator comprising:

an electromagnet for circulating a charged-particle beam;

an extracting unit for extracting said beam through a deflector; and said extracting unit having means for oscillating a center position of said beam as extracted by at least one of a high frequency electric field and a high frequency magnetic field.

44. A circular accelerator as claimed in claim 43, wherein said at least one of the electric field and the magnetic field is changed at a frequency synchronized with betatron oscillation of said beam.

45. A circular accelerator as claimed in claim 43, wherein an orbit gradient on extracting plane of said beam is changed by said at least one of the electric field and the magnetic field.

46. A circular accelerator comprising:

an electromagnet for circulating a charged-particle beam;

an extracting unit for extracting said beam through a deflector; and said extracting unit having means for causing a center position of said beam as extracted to shift from a vacuum duct toward said deflector by applying thereto at least one of a high frequency electric field and a high frequency magnetic field.

47. A circular accelerator as claimed in claim 46, wherein energy of said beam is changed by the high frequency electric field.

48. A circular accelerator as claimed in claim 47, wherein the high frequency electric field is applied through a high-frequency accelerating cavity.

49. A method of extracting a charged-particle beam in a circular accelerator comprising the steps of:

circulating a charged-particle beam through the circular accelerator;

applying at least one of a high frequency electric field and a high frequency magnetic field to said beam for moving a center position of said beam thereby extracting said beam from the circular accelerator.

50. A method as claimed in claim 49, further comprising the step of changing an intensity of said at least one of the electric field and the magnetic field applied to said beam for changing a position, an orbit gradient and a current of said beam as extracted.

51. A method of extracting a charged-particle beam in a circular accelerator comprising the steps of:

circulating a charged-particle beam through the circular accelerator;

applying at least one of a time-variable electric field and a time-variable magnetic field to said beam for moving a center position of said beam thereby extracting said beam from the circular accelerator;

changing an intensity of said at least one of the electric field and the magnetic field applied to said beam for changing a position, an orbit gradient and a current of said beam as extracted; and measuring a position, a current and a form of said charged-particle beam and determining an intensity of said at least one of the electric field and the magnetic field based on the measured position, current and form of said beam.

52. A method of extracting a charged-particle beam in a circular accelerator comprising the steps of:

circulating a charged-particle beam through the circular accelerator;

applying at least one of a high frequency electric field and a high frequency magnetic field to said beam for oscillating a center position of said beam; and extracting said beam through a deflector from the circular accelerator.

53. A method as claimed in claim 52, further comprising the step of changing an intensity of said at least one of the electric field and the magnetic field applied to said beam for changing a position, an orbit gradient and a current of said beam as extracted.

54. A method of extracting a charged-particle beam in a circular accelerator comprising the steps of:

circulating a charged-particle beam through the circular accelerator;

applying at least one of a time-variable electric field and a time-variable magnetic field to said beam for oscillating a center position of said beam;

changing an intensity of said at least one of the electric field and the magnetic field applied to said beam for changing a position, an orbit gradient and a current of said beam as extracted.

measuring a position, a current and a form of said charged-particle beam and determining an intensity of said at least one of the electric field and the magnetic field based on the measured position, current and form of said beam; and extracting said beam through a deflector from the circular accelerator.

55. A method of extracting a charged-particle beam through a deflector in a circular accelerator comprising the steps of:

circulating a charged-particle beam through the circular accelerator;

applying at least one of a high frequency electric field and a high frequency magnetic field to said beam for shifting a center position of said beam from a vacuum duct toward said deflector; and extracting said beam through said deflector from the circular accelerator.

56. A circular accelerator comprising:

an electromagnet for circulating a charged-particle beam; and means for extracting said charged-particle beam through an extracting deflector, wherein the extracted beam has a size of less than 3 mm.

57. A circular accelerator comprising:

an electromagnet for circulating a charged-particle beam; and means for extracting said charged-particle beam through an extracting deflector, wherein the extracted beam has an emittance of less than 1 $\pi$(mm mrad).

58. A circular accelerator comprising:

an electromagnet for circulating a charged-particle beam; and means for extracting said charged-particle beam through an extracting deflector, wherein a variation of a position of the extracted beam is less than 3 mm.

59. A circular accelerator comprising:

an electromagnet for circulating a charged-particle beam; and means for extracting said charged-particle beam through an extracting deflector, wherein the beam is extracted with a constant efficiency.

60. A circular accelerator comprising:

an electromagnet for circulating a charged-particle beam;

means for extracting said charged-particle beam through an extracting deflector, said extracting means including:

means for resonating betatron oscillations of said beam, and means for increasing betatron oscillation amplitudes of said beam which are within a stability limit of resonance.

61. A medical system comprising the circular accelerator as claimed in claim 60, a beam transport line for transporting a beam of the extracted charged particles to an irradiation room, and means provided in said irradiation room for irradiating the transported beam onto a given subject.

62. A circular accelerator comprising:

an electromagnet for circulating a charged-particle beam;

means for extracting said charged-particle beam through an extracting deflector, said extracting means including:

means for resonating betatron oscillations of said beam, and means for increasing betatron oscillation amplitudes of said beam which are within a stability limit of resonance while substantially keeping said stability limit constant

63. A circular accelerator comprising:

means for circulating a charged-particle beam;

means for resonating betatron oscillations of at least a part of charged particles of said beam which exceed a stability limit of resonance;

means for increasing amplitudes of said betatron oscillations of a remaining part of the charged particles of said beam which are within a stability limit of resonance thereby causing said remaining part of the charged particles to exceed said stability limit; and means for extracting said part and remaining part of the charged particles of said beam through an extracting deflector.

* * * * *